US012078090B1

(12) United States Patent
Le et al.

(10) Patent No.: US 12,078,090 B1
(45) Date of Patent: Sep. 3, 2024

(54) OIL FILTER HOUSING AND ASSEMBLY

(71) Applicant: Skyward Automotive Products LLC, Tolleson, AZ (US)

(72) Inventors: Danny Le, Gilbert, AZ (US); An Le, Gilbert, AZ (US)

(73) Assignee: Skyward Automotive Products LLC, Tolleson, AZ (US)

( * ) Notice: Subject to any disclaimer, the term of this patent is extended or adjusted under 35 U.S.C. 154(b) by 0 days.

(21) Appl. No.: 18/591,849

(22) Filed: Feb. 29, 2024

(51) Int. Cl.
*F01M 11/03* (2006.01)
*F01M 5/00* (2006.01)

(52) U.S. Cl.
CPC ..... *F01M 11/03* (2013.01); *F01M 2011/033* (2013.01)

(58) Field of Classification Search
CPC ..... F01M 11/03; F01M 5/001; F01M 1/10; F01M 2011/033; F01M 2011/0029; F01P 11/08; F01P 2060/04
See application file for complete search history.

(56) References Cited

U.S. PATENT DOCUMENTS 3,353,590 A 11/1967 Holman
4,426,965 A 1/1984 Patel
5,090,376 A 2/1992 Bedi
5,351,664 A 10/1994 Rotter et al.
5,477,817 A 12/1995 Hufendiek et al.
5,934,241 A * 8/1999 Von Esebeck ..... F01M 1/02 123/196 R
5,950,715 A 9/1999 Jonsson et al.
6,224,758 B1 5/2001 Jainek et al.
6,267,094 B1 7/2001 Kuettner et al.
6,353,804 B1 3/2002 Bowman
6,463,904 B2 10/2002 Weindorf
6,884,348 B2 4/2005 Baumann
7,353,794 B2 4/2008 Gruner et al.
(Continued)

FOREIGN PATENT DOCUMENTS

CN 2495816 Y 6/2002
CN 2541608 Y 3/2003
(Continued)

OTHER PUBLICATIONS

BMWPartsDeal.com, BMW 11428642288 Genuine Oil Filter, retrieved from the Internet: https://www.bmwpartsdeal.com/parts/bmw-oil_filter-11428642288.html.
(Continued)

*Primary Examiner* — Grant Moubry
(74) *Attorney, Agent, or Firm* — MacMillan, Sobanski & Todd, LLC

(57) ABSTRACT

An oil filter assembly comprising an oil filter housing having an oil filter housing first portion having an oil filter housing first portion first end, an opposing oil filter housing first portion second end, an oil filter housing first portion first surface and an opposing oil filter housing first portion second surface; an oil filter housing second portion having an oil filter housing second portion first surface, an oil filter housing second portion second surface opposing the oil filter housing second portion first surface, and a perimeter wall extending fully around the oil filter housing second portion and orthogonally away from the oil filter housing second portion first surface; an oil filter; and an oil cooler.

20 Claims, 15 Drawing Sheets

(56) References Cited

U.S. PATENT DOCUMENTS

| | | | | |
|---|---|---|---|---|
| 7,669,437 | B2 | 3/2010 | Sanada | |
| 7,717,070 | B2 | 5/2010 | Kanig et al. | |
| 8,104,581 | B2 | 1/2012 | Gendermann | |
| 8,635,984 | B2 | 1/2014 | Ardes | |
| 8,783,216 | B2 | 7/2014 | Wilmink et al. | |
| 9,635,984 | B2 | 5/2017 | Pierce | |
| 9,745,876 | B2 | 8/2017 | Fontecchio et al. | |
| 10,059,380 | B1 | 8/2018 | Fiest et al. | |
| 10,195,553 | B2 | 2/2019 | Baxter | |
| 10,723,427 | B1 | 7/2020 | Egleston et al. | |
| 10,920,628 | B2 | 2/2021 | Lochrane et al. | |
| 11,339,692 | B2 | 5/2022 | Girondi | |
| 11,365,670 | B2 | 6/2022 | Neal et al. | |
| 11,421,578 | B1 * | 8/2022 | Langenfeld | F02M 35/10157 |
| 11,635,005 | B2 * | 4/2023 | Kelly | F01M 11/03 123/196 A |
| 11,639,674 | B2 | 5/2023 | Kelly et al. | |
| 11,639,675 | B2 | 5/2023 | Kelly et al. | |
| 11,821,346 | B2 | 11/2023 | Chen et al. | |
| 2002/0023612 | A1 | 2/2002 | Weindorf | |
| 2005/0023200 | A1 | 2/2005 | Ueshima et al. | |
| 2006/0081361 | A1 | 4/2006 | Gabbey et al. | |
| 2006/0219208 | A1 | 10/2006 | Chonan et al. | |
| 2007/0068737 | A1 | 3/2007 | Gendermann | |
| 2007/0175434 | A1 * | 8/2007 | Gruner | B01D 35/18 123/196 AB |
| 2007/0215307 | A1 | 9/2007 | Kallien | |
| 2008/0128345 | A1 | 6/2008 | Sotiriades | |
| 2008/0314572 | A1 | 12/2008 | Hommes | |
| 2009/0038580 | A1 | 2/2009 | Hamilton | |
| 2009/0194061 | A1 | 8/2009 | Ardes | |
| 2010/0000708 | A1 | 1/2010 | Kiemlen et al. | |
| 2014/0131129 | A1 | 5/2014 | Galsworthy et al. | |
| 2015/0246303 | A1 | 9/2015 | Ben-Shimon et al. | |
| 2016/0318569 | A1 | 11/2016 | Zellmer et al. | |
| 2017/0058729 | A1 | 3/2017 | Lochrane et al. | |
| 2017/0279179 | A1 | 9/2017 | Park | |
| 2018/0320980 | A1 | 11/2018 | Coban et al. | |
| 2019/0023322 | A1 | 1/2019 | Haselhorst et al. | |
| 2019/0284975 | A1 * | 9/2019 | Saupe | F01M 5/007 |
| 2019/0316499 | A1 | 10/2019 | Girondi | |
| 2022/0056823 | A1 | 2/2022 | Kelly et al. | |
| 2022/0074327 | A1 | 3/2022 | Kelly et al. | |
| 2022/0266179 | A1 | 8/2022 | Yadav et al. | |
| 2023/0061996 | A1 | 3/2023 | Kelly et al. | |
| 2023/0243282 | A1 | 8/2023 | Perotto et al. | |
| 2023/0243283 | A1 | 8/2023 | Kelly et al. | |
| 2023/0287813 | A1 | 9/2023 | Chen et al. | |
| 2024/0060435 | A1 | 2/2024 | Kelly et al. | |

FOREIGN PATENT DOCUMENTS

| | | | | | |
|---|---|---|---|---|---|
| CN | 2869333 | Y | | 2/2007 | |
| CN | 201106482 | Y | | 8/2008 | |
| CN | 201129195 | Y | | 10/2008 | |
| CN | 101435365 | A | | 5/2009 | |
| CN | 101629510 | A | | 1/2010 | |
| CN | 101737119 | A | | 6/2010 | |
| CN | 201826944 | U | | 5/2011 | |
| CN | 201874638 | U | | 6/2011 | |
| CN | 202012424 | U | | 10/2011 | |
| CN | 102359405 | A | | 2/2012 | |
| CN | 103075225 | A | | 5/2013 | |
| CN | 101737119 | B | | 6/2013 | |
| CN | 203050840 | U | | 7/2013 | |
| CN | 103291408 | A | | 9/2013 | |
| CN | 203394606 | U | | 1/2014 | |
| CN | 103670584 | A | | 3/2014 | |
| CN | 103670657 | A | | 3/2014 | |
| CN | 104234779 | A | | 12/2014 | |
| CN | 204098986 | U | | 1/2015 | |
| CN | 103075225 | B | | 9/2015 | |
| CN | 105275574 | A | | 1/2016 | |
| CN | 103410585 | B | | 6/2016 | |
| CN | 104234780 | B | | 8/2016 | |
| CN | 205779089 | U | | 12/2016 | |
| CN | 106437938 | A | | 2/2017 | |
| CN | 106593574 | A | | 4/2017 | |
| CN | 109595050 | A | * | 4/2019 | F01M 1/16 |
| CN | 109611174 | A | | 4/2019 | |
| CN | 109630233 | A | | 4/2019 | |
| CN | 209637836 | U | | 11/2019 | |
| CN | 111102034 | A | | 5/2020 | |
| CN | 210660244 | U | | 6/2020 | |
| CN | 112709808 | A | | 4/2021 | |
| CN | 113187885 | A | * | 7/2021 | F01P 3/20 |
| CN | 114159877 | A | | 3/2022 | |
| CN | 114517720 | A | | 5/2022 | |
| CN | 114517721 | A | | 5/2022 | |
| CN | 216866816 | U | | 7/2022 | |
| CN | 113503200 | B | | 10/2022 | |
| CN | 218324991 | U | | 1/2023 | |
| DE | 10134827 | A1 | * | 5/2002 | B01D 35/147 |
| DE | 202004018136 | U1 | | 11/2005 | |
| DE | 202004015748 | U1 | | 2/2006 | |
| DE | 202004016183 | U1 | | 3/2006 | |
| DE | 202005014632 | U1 | | 2/2007 | |
| DE | 102009041525 | A1 | | 3/2011 | |
| DE | 102011100385 | A1 | | 11/2012 | |
| DE | 102014008249 | A1 | | 12/2015 | |
| DE | 102004003231 | B4 | | 10/2017 | |
| EP | 0969185 | A1 | * | 5/2000 | F01M 5/00 |
| EP | 0816645 | B1 | | 10/2001 | |
| EP | 1211390 | A1 | | 6/2002 | |
| EP | 1580409 | A2 | | 9/2005 | |
| EP | 1211390 | B1 | | 7/2006 | |
| EP | 2305360 | B1 | | 7/2012 | |
| EP | 2532848 | B1 | | 8/2016 | |
| JP | 2004346889 | A | | 12/2004 | |
| KR | 200397410 | Y1 | | 10/2005 | |
| KR | 20070012454 | A | | 1/2007 | |
| KR | 20080073009 | A | | 8/2008 | |
| KR | 20010006974 | U | | 7/2011 | |
| KR | 101190220 | B1 | | 10/2012 | |
| KR | 101735210 | B1 | | 5/2017 | |
| WO | 0236940 | A1 | | 5/2002 | |
| WO | 2005031128 | A2 | | 4/2005 | |
| WO | 2006005328 | A1 | | 1/2006 | |
| WO | 2012061928 | A1 | | 5/2012 | |
| WO | WO-2023180117 | A1 | * | 9/2023 | B01D 35/30 |

OTHER PUBLICATIONS

BMW, SI B11 14 15 Engine, Oct. 2015 Technical Service, retrieved from the Internet Nov. 2015, pp. 1-4.

BMW, SI B11 14 15 Engine, Oct. 2015 Technical Service, This Service Information bulletin supersedes SI B11 14 15 dated Oct. 2015, NEW, designates changes to this revision, retrieved from the Internet Feb. 2016, pp. 1-4.

Bmwtechnician, Mechanix with Andreas, N20 oil filter housing recall, posted on Oct. 14, 2015 by bmwtechician, retrieved from the Internet: https://bmwtechnician.com/2015/10/14/n20-oil-filter-housing-recall/.

Chrysler IIIH Engine Assembly Manual, Rev. 1, Revision Release Date: Jun. 14, 2018, pp. 1-100.

Dorman Products Part No. 918-428, dormanproducts.com, Engine Oil Cooler offered for sale, retrieved from the Internet Jun. 13, 2023: https://www.dormanproducts.com/p-133319-918-428.aspx.

Dorman Products Part No. 918-432, dormanproducts.com, Engine Oil Cooler offered for sale, retrieved from the Internet Jun. 13, 2023: https://www.dormanproducts.com/p-98680-918-432.aspx.

Dorman Products Part No. 926-876, dormanproducts.com, Engine Oil Filter Adapter, Upgraded Aluminum Engine Oil Filter Housing, retrieved from the Internet Jun. 15, 2023: https://www.dormanproducts.com/p-135210-926-876.aspx.

Dorman Technical Note, Installation, 918-432, Engine Oil Cooler, p. 1 of 1.

Dorman Coolers, Power Steering, Transmission, & Engine Oil Coolers, retrieved Jun. 13, 2023, www.dormanproducts.com, pp. 1-2.

(56) References Cited

OTHER PUBLICATIONS

Dorman, OE FIX, Guide, vol. 3, 926-876 OE FIX oil filter housing, (2021), www.dormanproducts.com, pp. 1-24.
Dorman, Service Dealer Guide, vol. 1, Spring 2018, p. 19, Engine, Engine Oil Coolers, Engine Oil Cooler Gasket Set, BMW Vanos Seal Kit, dormanproducts.com, pp. 1-28.
Dorman, Service Dealer Guide, vol. 2, Fall 2017, p. 14, Diesel, Over 600 SKUS Covering Dodge, Ford & GMC, Engine Oil Cooler Mount, Engine Valve Cover Gasket, dormanproducts.com, pp. 1-32.
Kallien et al., "Pressure die castings with functional cavities produced by gas injection", International Foundry Research/Giessereiforschung, (2006), Die casting, vol. 58, No. 4, pp. 2-9.
Mini., Owner's Manual., Contents A-Z, Online Edition for Part No. 01 40 2 927 905, (2014), pp. 1-230.
NMY Auto Parts, catalog, pp. 1-68, retrieved from the internet: www.nmyotomotiv.com.
Parker Hannifin Corporation, Composite Sealing Systems Division, Fastener and Fitting Seals, (2018), pp. 1-15, www.parker.com.
Pentastar Engine Family, Chrysler Group V-6 Offerings, Aug. 28, 2013, China-market introduction of 3.0 liter Pentastar replacement of seventh Chrysler Group V-6, pp. 1-2.
Pentastar 3.6L Oil leak. Problem done, Jan. 30, 2020, dodgeforum.com, URL: https://dodgeforum.com/forum/jeeps/428670-pentastar-3-6l-oil-leak-problem-done.html.
Ram Pickup 1500, Service Manual, "2014 Accessories and Equipment" Diagnostic Code Index, pp. 11297-11306.
Schleusener et al., "The Innovative Cooling System of the New Four-cylinder Gasoline Engines from GM Powertrain Europe", MTZ, (2006), vol. 67, pp. 6-9.
Weidler et al., "Using Gas Injection in High Pressure Die Casting Technology", Die Casting Engineer, (2009), pp. 50-52.
Oil Filter Adapter Housing Assembly 68105583AF, 68105583AE, Fits for 2014-2018 Chrysler 200, 300, Town Country, Dodge Challenger, Charger, Grand Cherokee, Ram ProMaster 1500 3.6 V6, Oil Cooler Kit, (Year 2019), retrieved May 1, 2024: https://www.amazon.com/Engine-Cooler-Filter-Housing-Adapter/dp/B07HS2SSSR?th=1.
MangoS Replacement for Engine Oil Filter Housing Adapter Assembly 68105583AF 68105583AE for 2014 2015 2016 2017 Chrysler Dodge Ram, Grand Wrangler, 3.6L V6 (2020), retrieved May 1, 2024: https://www.amazon.com/replacement-Assembly-68105583AF-68105583AE-Chrysler/dp/B086M57NM3?source=ps-sl-shoppingads-lpcontect&ref=fplfs&psc=1&smid=A3Q5WB1U3AUUOV.
ONER Engine Oil Cooler and Oil Filter Housing Adapter Assembly, Fit for 2014-2017 Chrysler 200/300 Dodge, Jeep, Ram 3.6L V6 Engine, Replaces # 68105583AA, 68105583AC, 6815583AD, 68105583A, 68105583AF, (2020), retrieved May 1, 2024: https://www.amazon.com/ONER-68105583AA-68105583AC-68105583AD-68105583A%EF%BC%8C68105583AF/dp/B08937GMZK?source=ps-sl-shopingads-lpcontext&ref=fplfs&smid=A3S3892600WGZD&th=1.
YouTube, titled "Highlighted Part: Engine Oil Cooler Mount for Select Ford F-Series Models", by @DormanProducts, published on Sep. 13, 2017, (Dorman), attempted to retrieved from the Internet May 1, 2024: https://www.youtube.com/watch?v=Tqk05R9hlsQ.
File History, U.S. Appl. No. 17/406,639, now U.S. Pat. No. 11,635,005, issued Apr. 25, 2023.
File History, U.S. Appl. No. 17/528,884, now U.S. Pat. No. 11,639,674, issued May 2, 2023.
File History, U.S. Appl. No. 17/985,565, now U.S. Pat. No. 11,639,675, issued May 2, 2023.
File History, U.S. Appl. No. 63/068,759, filed Aug. 21, 2020.
After Final Reply and Amendment, U.S. Appl. No. 17/406,639, dated Feb. 10, 2023.

* cited by examiner

OIL FILTER HOUSING AND ASSEMBLY

FIELD

The disclosure relates to internal combustion engines. More particularly, this disclosure relates to oil filter housings and assemblies that include an oil filter housing. The oil filter housings and assemblies are useful in filtering and cooling lubrication oil used in internal combustion engines.

BACKGROUND

Oil filter housings are critical components of some internal combustion engines. Oil filter assemblies typically include an oil filter and an oil cooler secured to a housing component. Multiple conventional oil filter assemblies include a housing component that is a single, unitary component. In other words, the housing component of several conventional oil filter assemblies has a unitary construction comprising only a single part, which can be formed of plastic or cast as a metal part. While these unitary housing components may simplify manufacturing processes, they, ironically, provide multiple distinct points of failure by including multiple distinct flow ports that lack a common structure away and distinct from the unitary housing component.

A need remains, therefore, for improved oil filter housings and oil filter assemblies that include an improved oil filter housing.

BRIEF SUMMARY OF SELECTED EXAMPLES

Various example oil filter housings and oil filter assemblies are described.

An example oil filter assembly comprises an oil filter housing having an oil filter housing first portion having an oil filter housing first portion first end and an opposing oil filter housing first portion second end, an oil filter housing first portion surface and an opposing oil filter housing first portion second surface, the first portion first end defining an oil filter tube, the second end defining first and second flow ports, the first surface adapted for a secured connection with an internal combustion engine; an oil filter housing second portion having an oil filter housing second portion first surface, an oil filter housing second portion second surface opposing the oil filter housing second portion first surface, a perimeter wall extending fully around the oil filter housing second portion and orthogonally away from the oil filter housing second portion first surface, the oil filter housing second portion defining first and second holes extending through the oil filter housing second portion from the oil filter housing second portion first surface to the oil filter housing second portion second surface, the oil filter housing second portion disposed on the oil filter housing first portion such that the first flow port extends through the first hole, the second flow port extends through the second hole, and the perimeter wall extends toward the oil filter housing first portion; an oil filter adapted to be disposed within the oil filter tube; and an oil cooler adapted to be secured to the oil filter housing first portion first surface.

Another example oil filter assembly comprises an oil filter housing having an oil filter housing first portion having an oil filter housing first portion first end, an opposing oil filter housing first portion second end, an oil filter housing first portion first surface, and an opposing oil filter housing first portion second surface, the oil filter housing first portion first end defining an oil filter tube, the oil filter housing first portion second end defining a flow port, the oil filter housing first portion first surface adapted for a secured connection with an internal combustion engine; an oil filter housing second portion having an oil filter housing second portion first surface, an oil filter housing second portion second surface opposing the oil filter housing second portion first surface, a perimeter wall extending fully around the oil filter housing second portion and orthogonally away from the oil filter housing second portion first surface, the oil filter housing second portion defining a hole extending through the oil filter housing second portion from the oil filter housing second portion first surface to the oil filter housing second portion second surface, the oil filter housing second portion disposed on the oil filter housing first portion such that the flow port extends through the hole, and the perimeter wall extends toward the oil filter housing first portion; an oil cooler having an oil cooler first surface and an oil cooler second surface removably attached to the oil filter housing first portion first surface; and an oil filter adapted to be disposed within the oil filter tube.

Another example oil filter assembly comprises an oil filter housing having an oil filter housing first portion having an oil filter housing first portion first end, an opposing oil filter housing first portion second end, an oil filter housing first portion first surface and an opposing oil filter housing first portion second surface, the oil filter housing first portion first end defining an oil filter tube, the oil filter housing first portion second end defining a flow port, the first surface adapted for a secured connection with an internal combustion engine, the oil filter housing first portion having an oil filter housing first portion vertical channel extending from the oil filter housing first portion first surface to the oil filter housing first portion second surface; an oil filter housing second portion having an oil filter housing second portion first surface, an oil filter housing second portion second surface opposing the oil filter housing second portion first surface, a perimeter wall extending fully around the oil filter housing second portion and orthogonally away from the oil filter housing second portion first surface, the oil filter housing second portion defining a hole extending through the oil filter housing second portion from the oil filter housing second portion first surface to the oil filter housing second portion second surface, the oil filter housing second portion disposed on the oil filter housing first portion such that the flow port extends through the hole, and the perimeter wall extends toward the oil filter housing first portion; an oil cooler having an oil cooler first surface and an oil cooler second surface removably attached to the oil filter housing first portion first surface, the oil cooler having an oil cooler vertical channel extending from the oil cooler second surface in a direction toward the oil cooler first surface; and an oil filter adapted to be disposed within the oil filter tube.

Additional understanding of the inventive oil filter housings and oil filter assemblies can be obtained by reviewing the detailed description of selected examples, below, and the referenced drawings.

DETAILED DESCRIPTION OF SELECTED EXAMPLES

The following detailed description and the appended drawings describe and illustrate various example oil filter housings and example oil filter assemblies. The description and illustration of these examples enable one skilled in the art to make and use example oil filter housings and oil filter assemblies. They do not limit the scope of the claims in any manner.

Figure 1:
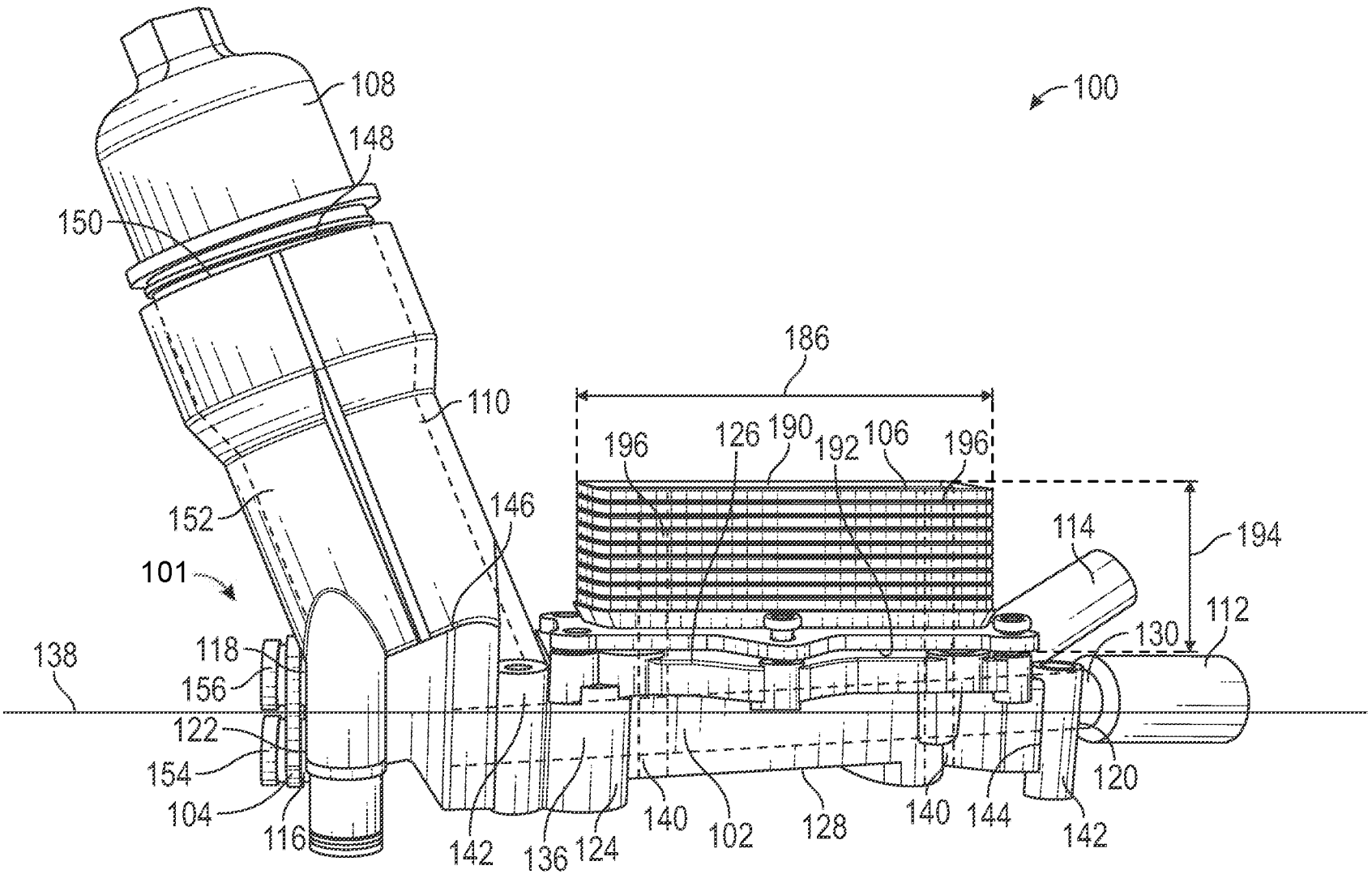
FIG. 1 is a first side view of a first example oil filter assembly.
Figure 2:
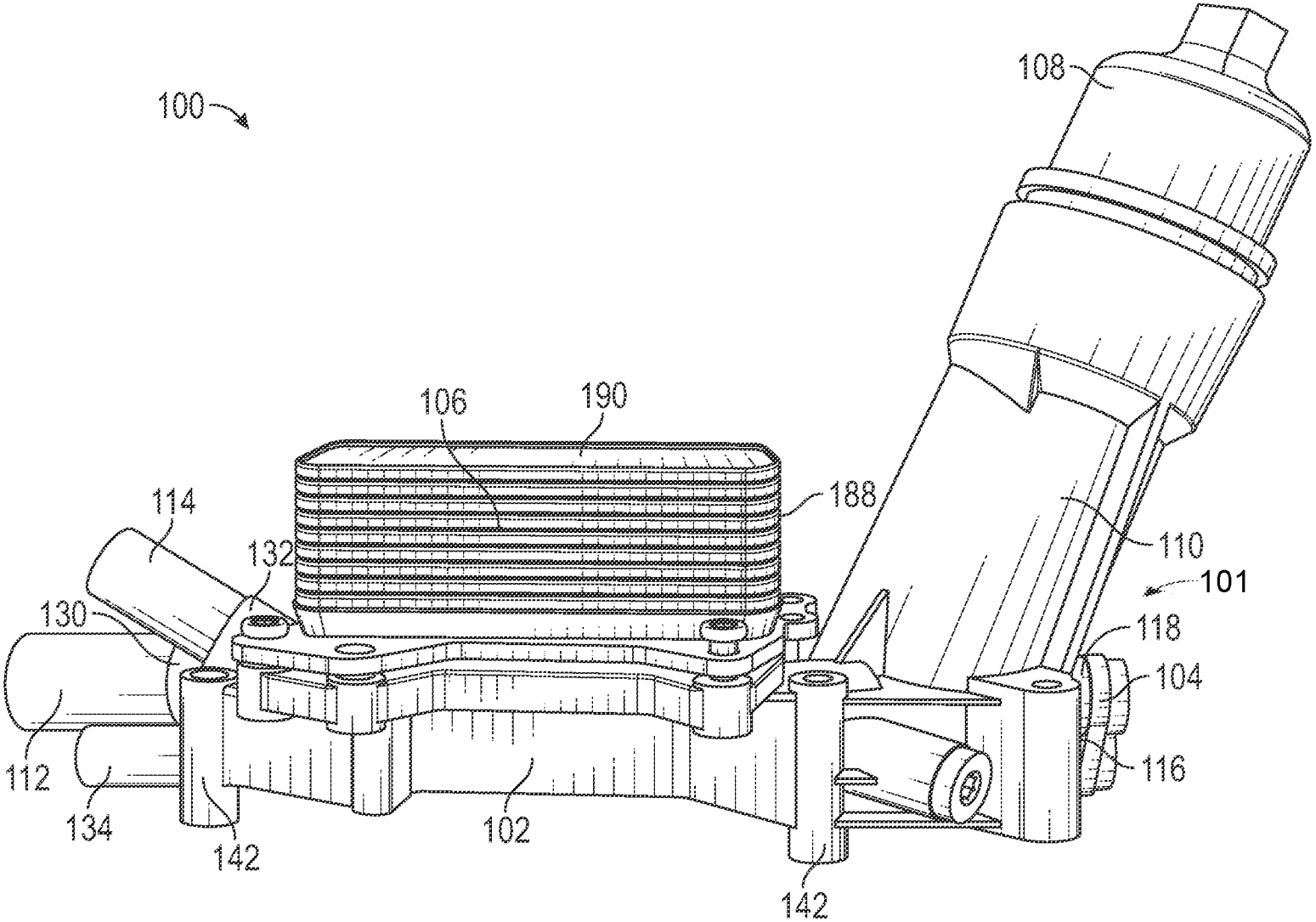
FIG. 2 is a second side view of the first example oil filter assembly.
Figure 3:
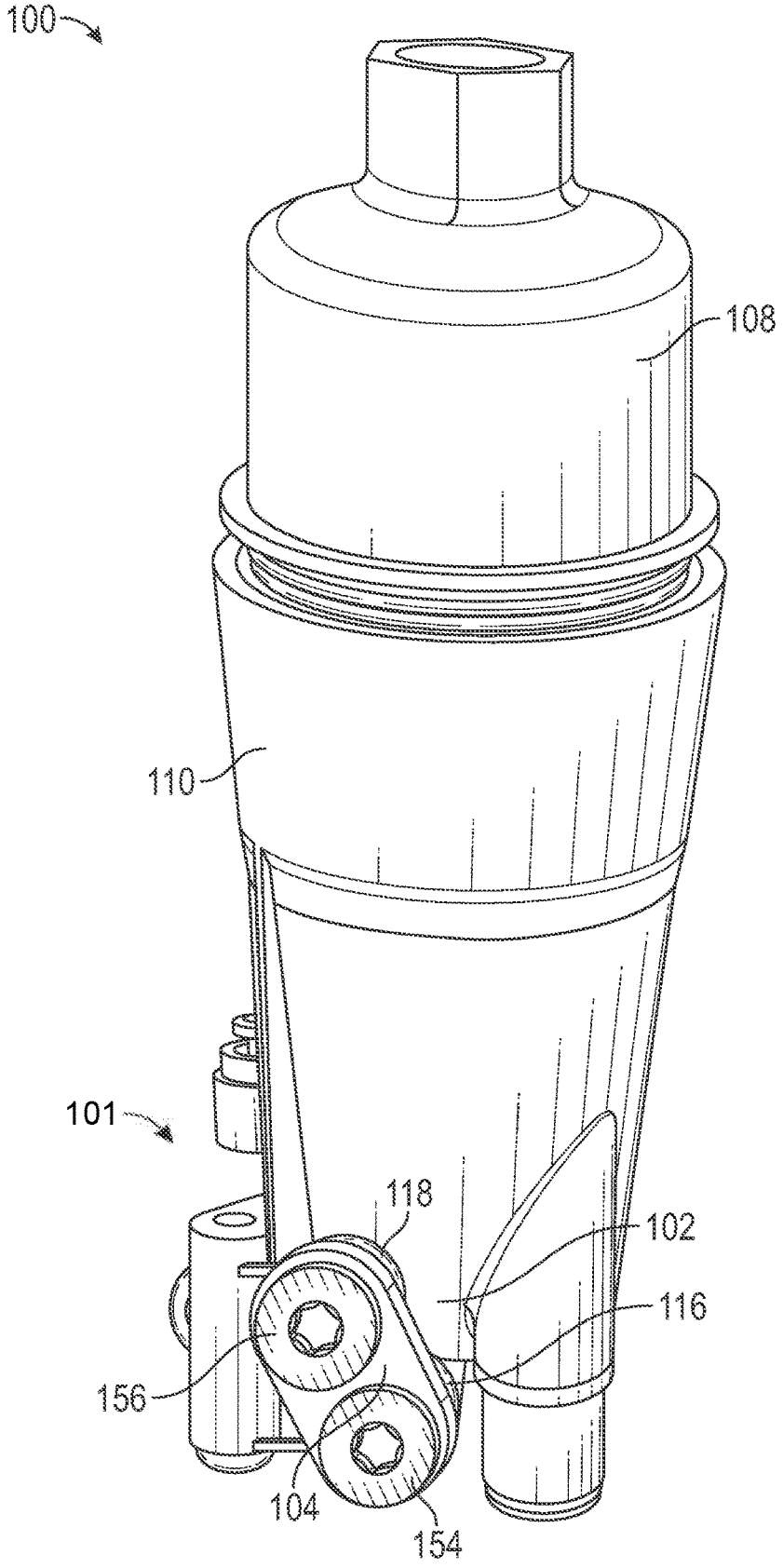
FIG. 3 is a third side view of the first example oil filter assembly.
Figure 4:
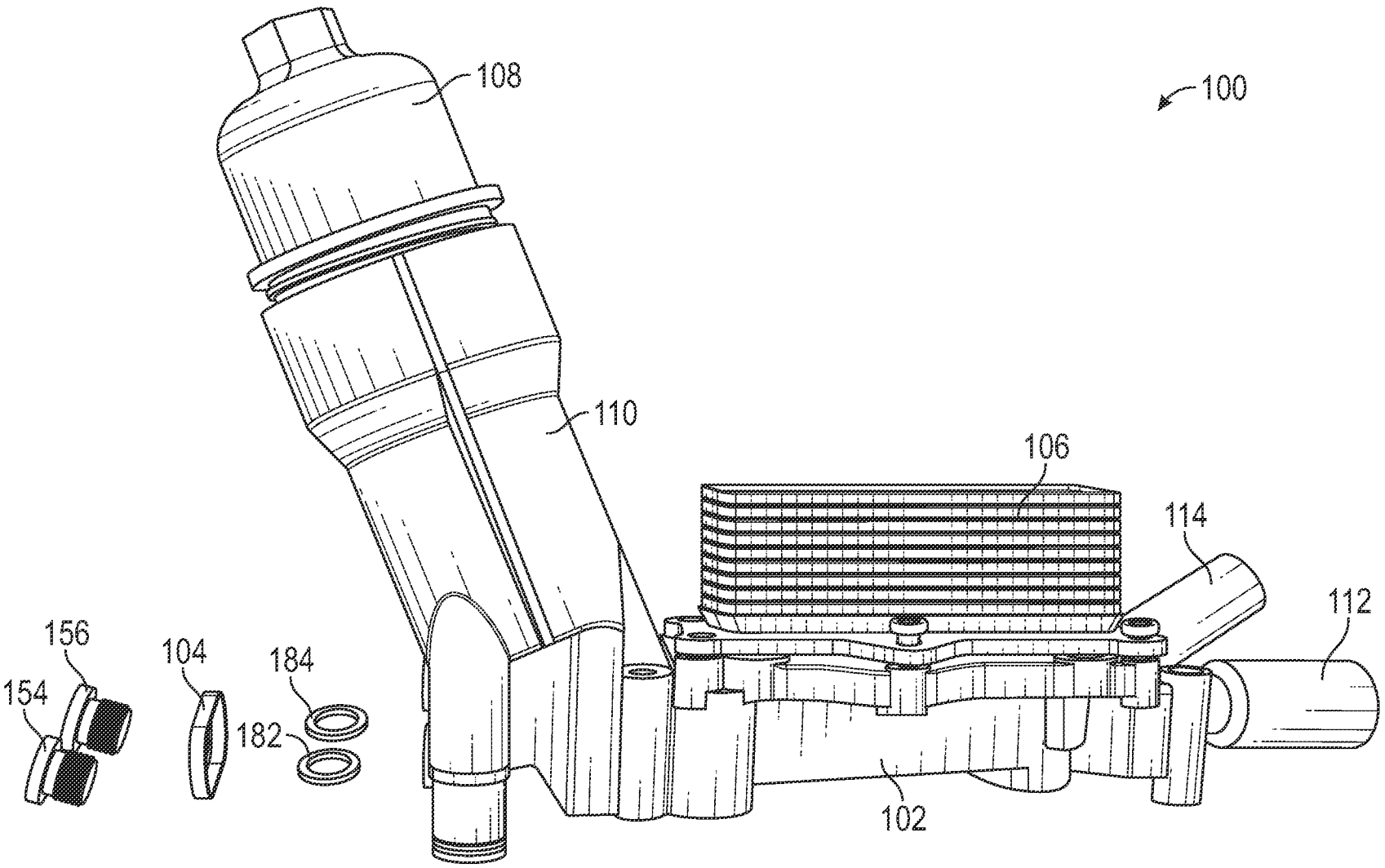
FIG. 4 is a partially exploded view of the first side of the first example oil filter assembly having an oil filter housing second portion removed from an oil filter housing first portion.

Each of FIGS. 1, 2, 3, and 4 illustrates a first example oil filter assembly 100. The oil filter assembly 100 includes an oil filter housing 101, an oil filter (not illustrated) disposed in an oil filter tube 110 defined by the oil filter housing 101, and an oil cooler 106. The oil filter housing 101 has an oil filter housing first portion 102 and an oil filter housing second portion 104. The oil filter assembly 100 further has a cap 108, a first electrical connector 112, a second electrical connector 114, a first flow port 116, and a second flow port 118.

As illustrated, the oil filter housing first portion 102 has an oil filter housing first portion first end 120, oil filter housing first portion second end 122, and an oil filter housing first portion intermediate portion 124 extending between the oil filter housing first portion first end 120 and the oil filter housing first portion second end 122. The oil filter housing first portion 102 further has an oil filter housing first portion first surface 126 and an oil filter housing first portion second surface 128. The oil filter housing first portion first end 120 comprises a first port 130 and a second port 132. The oil filter housing first portion first end 120 can have as many ports as desired including, but not limited to, one, three, five, or six. The first port 130 has the first electrical connector 112 at least partially disposed in the first port 130, and the second port 132 has the second electrical connector 114 at least partially disposed in the second port 132. The oil filter housing first portion first end 120 can also have a hose attachment point 134 in which extends away from the oil filter housing first portion first end 120. The hose attachment point 134 can be configured to receive a hose, not illustrated, to transfer oil from the oil filter assembly 100 to a motor or from the motor to the oil filter assembly 100. The oil filter housing first portion 102 can further have a channel 136 extending along an axis 138 within the oil filter housing intermediate portion 124 that oil can flow through. The oil filter housing first portion 102 can have any number of channels 136 extending along the axis 138 within the oil filter housing first portion intermediate portion 124 including, but not limited to, two, three, or four. The oil filter housing first portion 102 can be made from any desired material including, but not limited to metals, polymers, and ceramics.

The oil filter housing first portion intermediate portion 124 can have an oil filter housing first portion vertical channel 140 extending from the oil filter housing first portion first surface 126 and the oil filter housing first portion second surface 128. In the illustrated embodiment, the oil filter assembly 100 has four oil filter housing first portion vertical channels 140. However, the oil filter assembly 100 can have any number of oil filter housing first portion vertical channels 140 including, but not limited to, one, two, three, seven or ten. The oil filter housing first portion 102 can further have a plurality of retaining apertures 142 around an exterior perimeter 144 of the oil filter housing first portion 102. Each of the retaining apertures 142 is configured to receive a bolt. The retaining apertures 142 are configured to secure the oil filter assembly 100 in place. For example, the retaining apertures 142 can be used to secure the oil filter assembly 100 to a motor.

The oil filter housing first portion 102 further comprises the oil filter tube 110. The oil filter tube 110 can extend in a direction away from the oil filter housing first portion second surface 128. The oil filter tube 110 has an oil filter tube distal end 146 and an oil filter tube proximal end 148. The oil filter tube proximal end 148 can have an oil filter tube opening 150 having internal threads that are adapted to receive external threads of the cap 108. Although, in the illustrated embodiment, the oil filter tube opening 150 has internal threads and the cap 108 has external threads, in alternative embodiments the threads can be reversed. The cap 108 can be made from any desired material including, but not limited to, polymers and metals. The cap 108 can further have a filter attached thereto, and the filter is configured to be disposed within the oil filter tube 110 through the oil filter tube proximal end 148. The oil filter assembly 100 can further have an oil filter tube cavity 152 that extends from the oil filter tube 110 in a direction towards the second surface of the oil filter housing first portion 102. In the illustrated embodiment the oil filter tube cavity 152 has an O-ring that is configured to prevent oil from leaking from the oil filter assembly 100. Also, the oil filter tube 110 is adapted to receive an oil filter. The oil filter can be attached to the cap 108; however, it doesn't have to be. The cap 108 can also be made from a different material than the oil filter housing first portion 102 and the oil filter housing second portion 104.

The oil filter housing first portion 102 further includes the first flow port 116 and the second flow port 118. Although the illustrated embodiment only has two flow ports, any desired number of flow ports may be present including, but not limited to, one, three, four, six, or seven. The first flow port 116 and the second flow port 118 can serve as any desired functionality. For example, the first flow port 118 can transfer hot oil from the engine to be filtered and cooled prior to the return of cooled oil exiting the oil filter assembly 100 through the second flow port 118. Alternatively, the first flow port 116 and the second flow port 118 need not be used. The first flow port 116 and the second flow port 118 can be plugged by using a first bolt 154 and a second bolt 156 to prevent oil from leaving the oil filter assembly 100 through the first flow port 116 and the second flow port 118.

Figure 5:
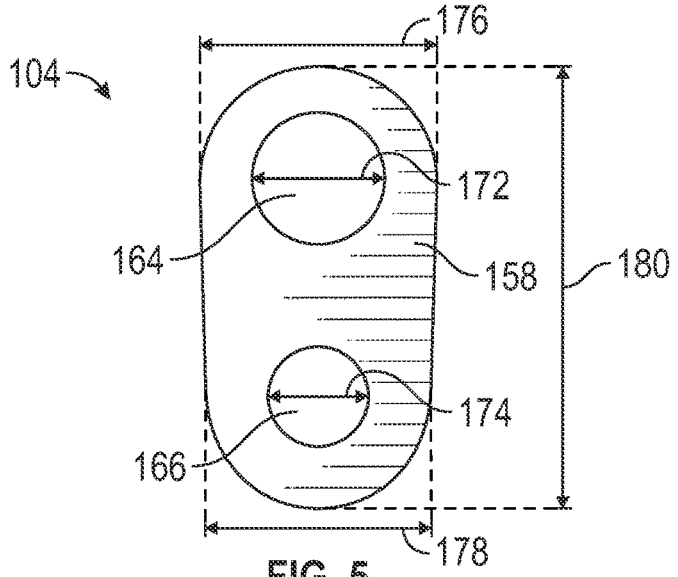
FIG. 5 is a top view of the oil filter housing second portion.
Figure 6:
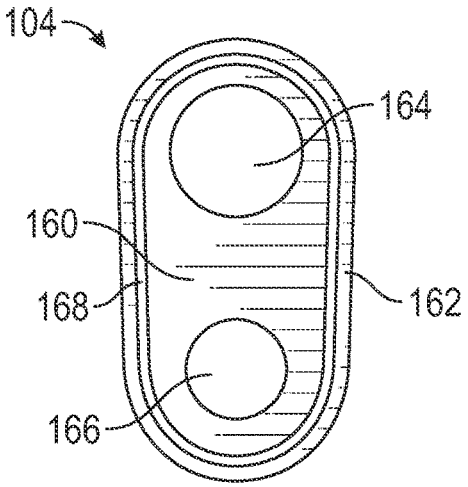
FIG. 6 is a bottom view of the oil filter housing second portion.
Figure 7:
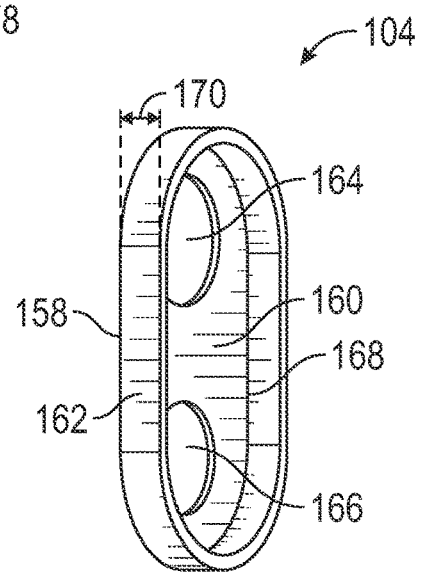
FIG. 7 is a first perspective view of the oil filter housing second portion.
Figure 8:
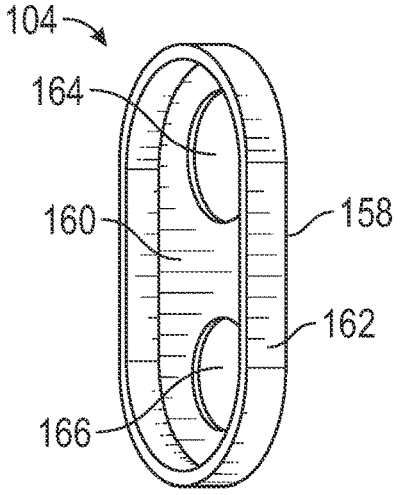
FIG. 8 is a second perspective view of the oil filter housing second portion.

Each of FIGS. 5, 6, 7, and 8 illustrates the oil filter housing second portion 104. In the illustrated embodiment the oil filter housing second portion 104 is ovular shaped; however, any desired shape is acceptable. The oil filter housing second portion 104 has an oil filter housing second portion first surface 158, an oil filter housing second portion second surface 160 opposing the oil filter housing second portion first surface 158, a perimeter wall 162. The oil filter housing second portion 104 defining a first hole 164 and a second hole 166 each of which extend through the oil filter housing second portion 104 from the oil filter housing second portion first surface 158 to the oil filter housing second portion second surface 160. In the illustrated embodiment, the perimeter wall 162 extends fully around the oil filter housing second portion 104 and orthogonally away from the oil filter housing second portion first surface 158. The perimeter wall 162 has a perimeter wall height 170 that is approximately 5 mm; however, the perimeter wall 162 can have any perimeter wall height 170 including, but not limited to, 1 mm, 2 mm, 4 mm, 6 mm, or 10 mm. The oil filter housing second portion 104 further includes the first hole 164 and the second hole 166 that extend from the oil filter housing second portion first surface 158 to the oil filter housing second portion second surface 160. In the illustrated embodiment, the first hole 164 has a first diameter 172, and the second hole 166 has a second diameter 174. The first diameter 172 being smaller than the second diameter 174. The first diameter 172 is approximately 14 mm and the second diameter 174 is approximately 16 mm. However, any desired diameter can be used for the first hole 164 and the second hole 166. Although the illustrated embodiment shows that the first hole 164 and the second hole 166 are different sizes, in alternative embodiments the first hole 164 and the second hole 166 can be the same size. The oil filter housing second portion 104 has an oil filter housing second portion first width 176 and an oil filter housing second portion second width 178. The oil filter housing second portion first width 176 being greater than the oil filter housing second portion second width 178. Although this embodiment of the oil filter housing second portion 104 is illustrated in this manner, the oil filter housing second portion first width 176 and the oil filter housing second portion second width 178 can be the same. For example, oil filter housing second portion first widths 176 can include, but are not limited to, approximately 10 mm to approximately 25 mm. Example oil filter housing second portion second widths 178 can include, but are not limited to, approximately 20 mm to approximately 30 mm. The oil filter housing second portion 104 also has an oil filter housing second portion length 180 that is approximately 46 mm. However, the oil filter housing second portion length 180 can be any desired length including, but not limited to, approximately 45 mm to approximately 50 mm. The oil filter housing second portion 104 is configured to be disposed on the oil filter housing first portion 102 such that the first flow port 116 extends through the first hole 164, the second flow port 118 extends through the second hole 166, and the perimeter wall 168 extends toward the oil filter housing first portion 102. A first washer 182 and a second washer 184 can be disposed between the oil filter housing second portion 104 and the oil filter housing first portion 102 to help prevent oil from leaking from the first flow port 116 and the second flow port 118. The oil filter housing second portion 104 provides several benefits to the oil filter assembly 100. To start with, the oil filter housing second portion 104 provides support to lines that can be installed from the motor to the oil filter assembly 100. Further, the oil filter housing second portion 104 provides a means to keep lines together while attaching them to the first flow port 116 and the second flow port 118. The lines are not illustrated; however, these lines can be replaced with the first bolt 154 and second bolt 156 when the first flow port 116 and the second flow port 118 are not in use. The oil filter housing second portion 104 can be made from any desired material including, but not limited to, metals, polymers, and ceramics. The material of the oil filter housing second portion 104 can be the same material, or a different material, than that of oil filter housing first portion 102.

The oil filter assembly 100 further comprises the oil cooler 106, best seen in FIGS. 1, 2, 3 and 4, that is removably attached to the oil filter housing first portion first surface 126. The oil cooler 106 has an oil cooler length 186, an oil cooler width 188, an oil cooler first surface 190, and an oil cooler second surface 192. The oil cooler 106 is removably attached to the oil filter housing first portion first surface 126 by a plurality of bolts; however, any means of attachment can be used to attach the oil cooler 106 to the oil filter housing first portion 102. An oil cooler height 194 extends from the oil cooler first surface 190 to the oil cooler second surface 192. The oil cooler 106 has at least one oil cooler vertical channel 196 extending from the oil cooler second surface 192 in a direction of the oil cooler first surface 190. Although not illustrated, the illustrated embodiment has four oil cooler vertical channels 196. These oil cooler vertical channels 196 allow oil to flow through the oil cooler 106 to help lower the temperature of the oil. The oil cooler vertical channels 196 are configured to mate with the oil filter housing first portion vertical channels 140 to allow oil to flow to and from the oil filter housing first portion 102.

Figure 9:
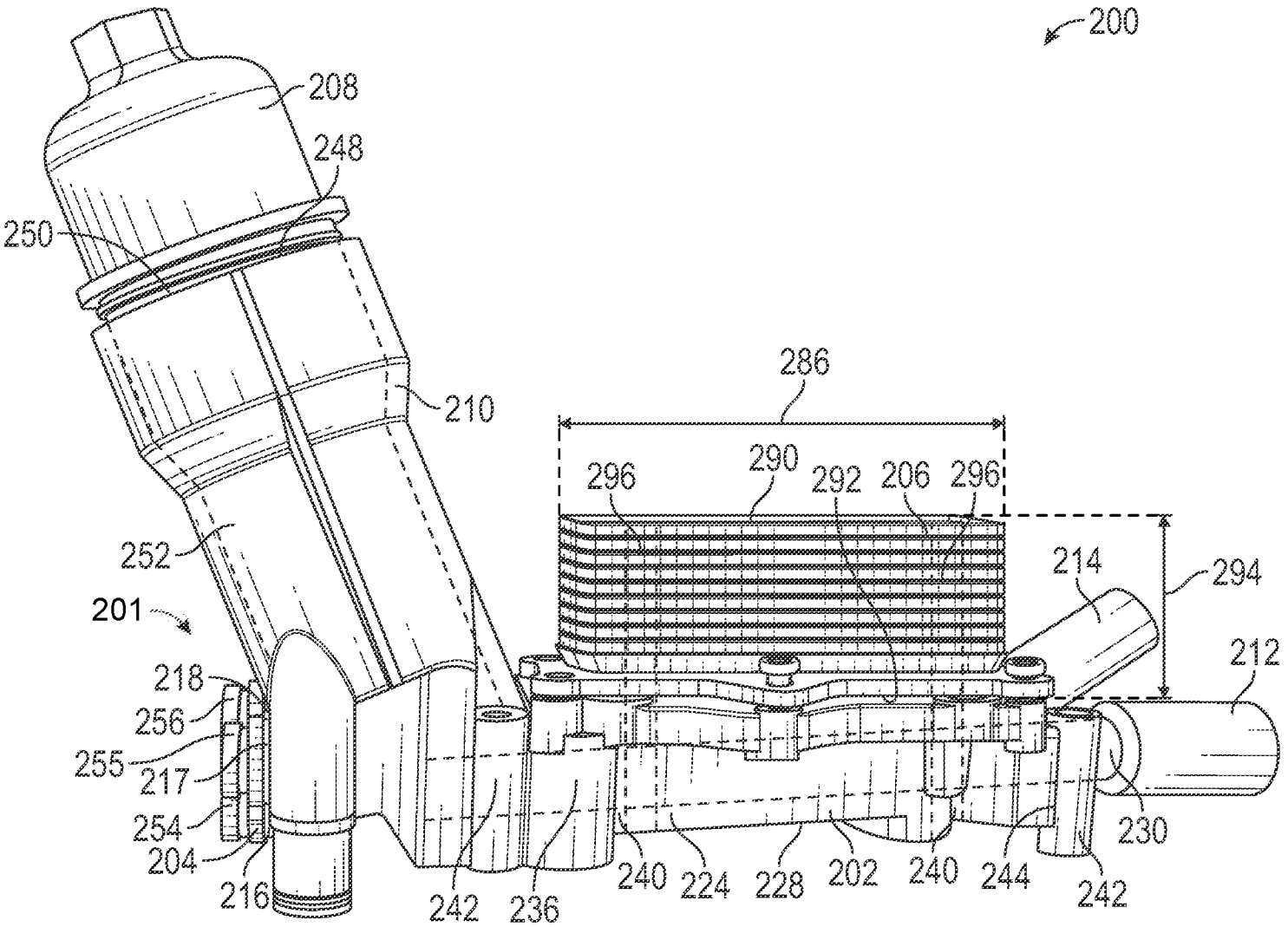
FIG. 9 is a first side view of a second example oil filter assembly.
Figure 10:
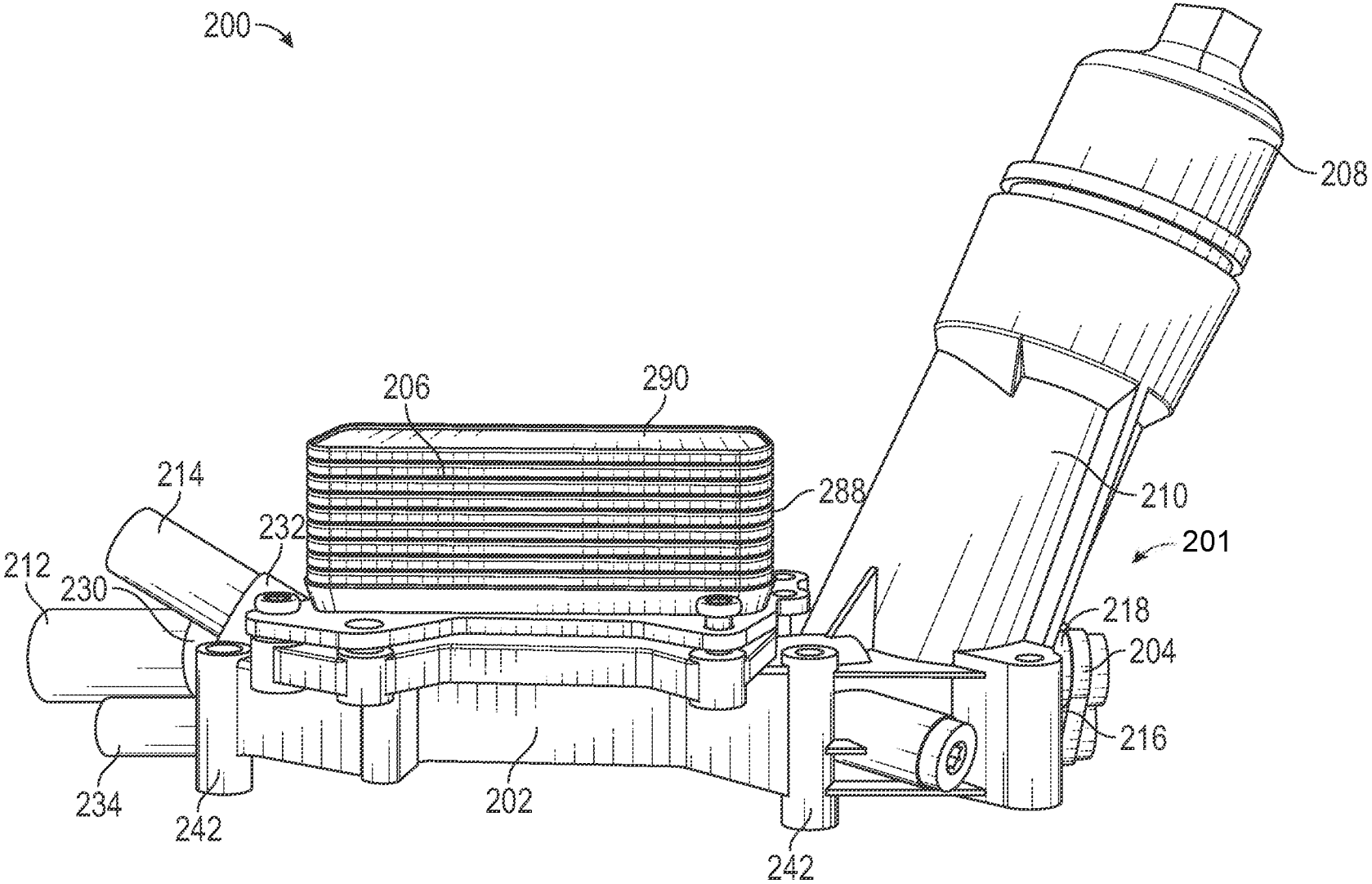
FIG. 10 is a second side view of the second example oil filter assembly.
Figure 11:
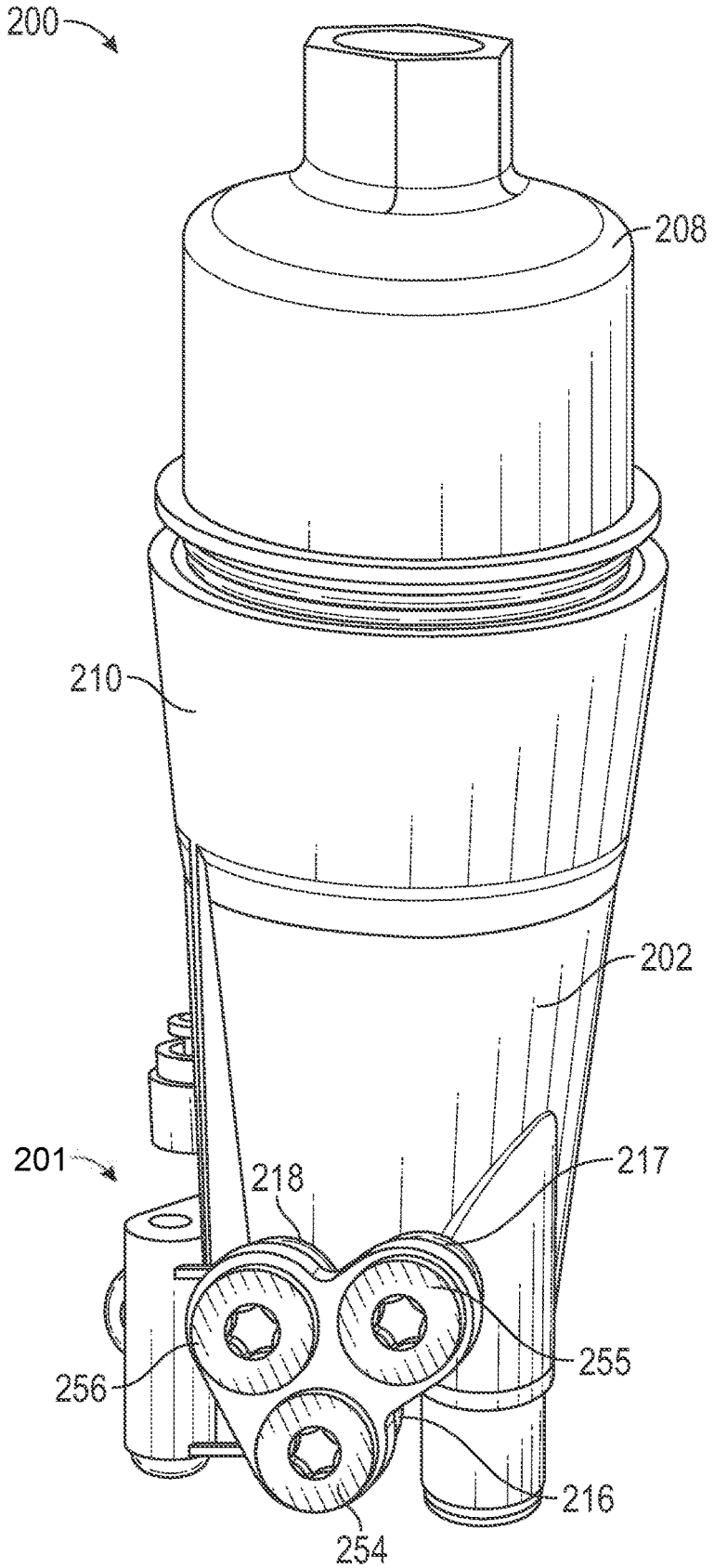
FIG. 11 is a third side view of the second example oil filter assembly.
Figure 12:
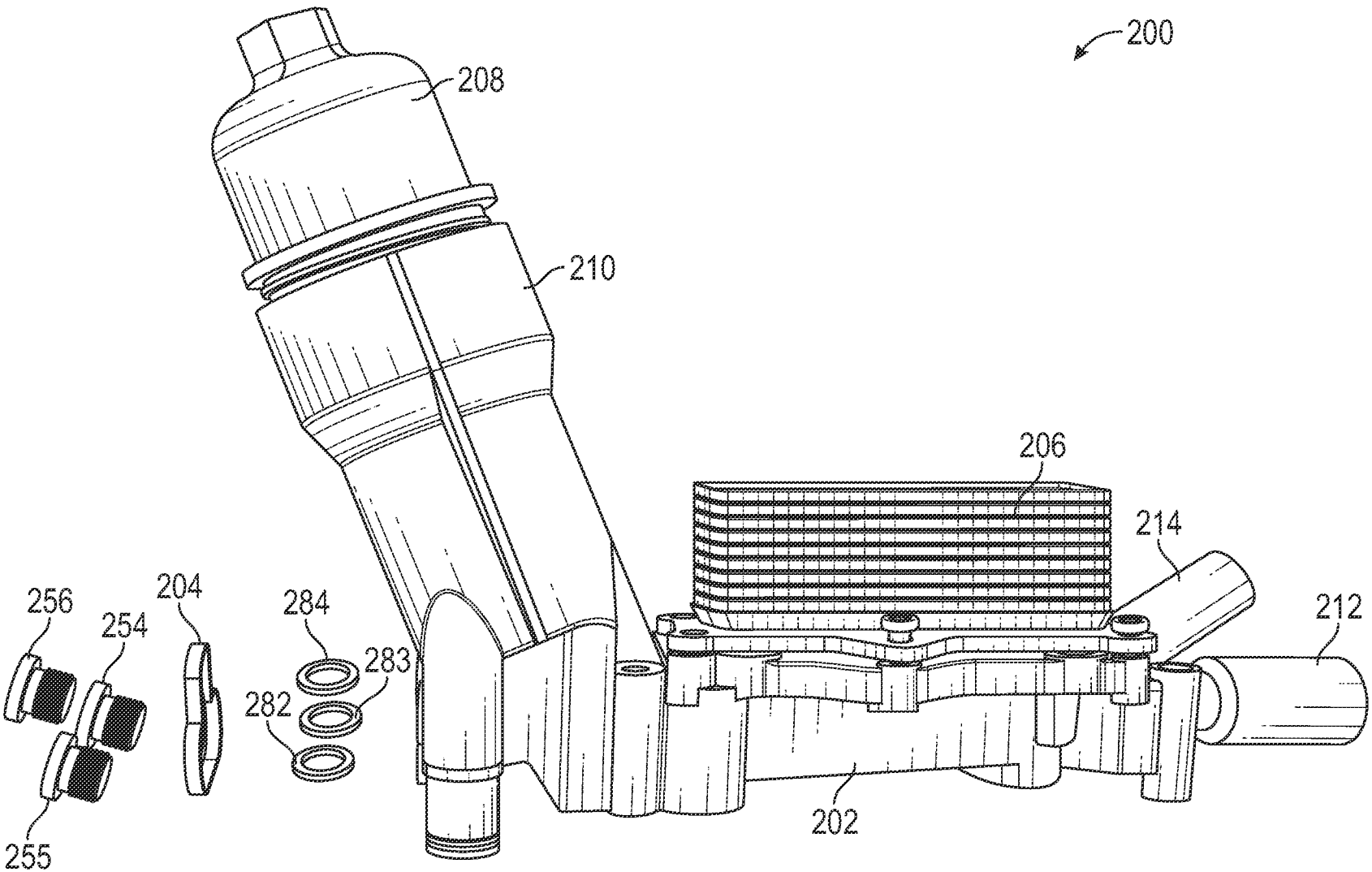
FIG. 12 is a partially exploded view of the first side view of the second example oil filter assembly having an oil filter housing second portion removed from an oil filter housing first portion.

Each of FIGS. 9, 10, 11, and 12 illustrates a second example oil filter assembly 200. The oil filter assembly 200 includes an oil filter housing 201, an oil filter (not illustrated) disposed in an oil filter tube 210 defined by the oil filter housing 101, and an oil cooler 206. The oil filter housing 201 has an oil filter housing first portion 202 and an oil filter housing second portion 204. The oil filter assembly 200 further has a cap 208, a first electrical connector 212, a second electrical connector 214, a first flow port 216, a second flow port 218, and a third flow port 217.

As illustrated, the oil filter housing first portion 202 has an oil filter housing first portion first end 220, an oil filter housing first portion second end 222, and an oil filter housing first portion intermediate portion 224 extending between the oil filter housing first portion first end 220 and the oil filter housing first portion second end 222. The oil filter housing first portion 202 further has an oil filter housing first portion first surface 226 and an oil filter housing first portion second surface 228. The oil filter housing first portion first end 220 comprises a first port 230 and a second port 232. The oil filter housing first portion first end 220 can have as many ports as desired including, but not limited to, one, three, five, or six. The first port 230 has the first electrical connector 212 at least partially disposed in the first port 230, and the second port 232 has the second electrical connector 214 at least partially disposed in the second port 232. The oil filter housing first portion first end 220 can also have a hose attachment point 234 in which extends away from the oil filter housing first portion first end 220. The hose attachment point 234 can be configured to receive a hose, not illustrated, to transfer oil from the oil filter assembly 200 to a motor or from a motor to the oil filter assembly 200. The oil filter housing first portion 202 can further have a channel 236 extending along an axis 238 within the oil filter housing first portion intermediate portion 224 that oil can flow through. The oil filter housing first portion 202 can have any number of channels 236 extending along the axis 238 within the oil filter housing first portion intermediate portion 224 including, but not limited to, two, three, four, or five. The oil filter housing first portion 202 can be made from any desired material including, but not limited to metals, polymers, and ceramics.

The oil filter housing first portion intermediate portion 224 can have an oil filter housing first portion vertical channel 240 extending from the oil filter housing first portion first surface 226 and the oil filter housing first portion second surface 228. In the illustrated embodiment, the oil filter assembly 200 has four oil filter housing first portion vertical channels 240. However, The oil filter assembly 200 can have any number of oil filter housing first portion vertical channels 240 including, but not limited to, one, two, three, seven or ten. The oil filter housing first portion 202 can further have a plurality of retaining apertures 242 around an exterior perimeter 244. Each of the retaining apertures 242 is configured to receive a bolt. The retaining apertures 242 are configured to secure the oil filter assembly 200 in place. For example, the retaining apertures 242 can be used to secure the oil filter assembly 200 to a motor.

The oil filter housing first portion 202 further comprises the oil filter tube 210. The oil filter tube 210 can extend in a direction away from the oil filter housing first portion second surface 228. The oil filter tube 210 has an oil filter tube distal end 246 and an oil filter tube proximal end 248. The oil filter tube proximal end 248 can have an oil filter tube opening 250 having internal threads that are adapted to receive external threads of the cap 208. Although in the illustrated embodiment the oil filter tube opening 250 has internal threads and the cap 208 has external threads, in alternative embodiments the threads can be reversed. The cap 208 can be made from any desired material including, but not limited to, polymers and metals. The cap 208 can further have a filter attached thereto, and the filter is configured to be disposed within the oil filter tube 210 through the oil filter tube proximal end 248. The oil filter assembly 200 can further have an oil filter tube cavity 252 that extends from the oil filter tube 210 in a direction towards the second surface of the oil filter housing first portion 202. In the illustrated embodiment, the oil filter tube cavity 252 has an O-ring that is configured to prevent oil from leaking from the oil filter assembly 200. Also, the oil filter tube 210 is adapted to receive an oil filter. The oil filter can be attached to the cap 208; however, it doesn't have to be. The cap 208 can also be made from a different material than the oil filter housing first portion 202 and the oil filter housing second portion 204.

The oil filter housing first portion 202 further includes the first flow port 216, the second flow port 218, and the third flow port 217. Although the illustrated embodiment has three flow ports, any desired number of flow ports may be present including, but not limited to, one, two, four, six, or seven. The first flow port 216, the second flow port 218, and third flow port 217 can serve as any desired functionality. For example, the first flow port can transfer hot oil from the engine to be filtered and cooled prior to the return of cooled oil exiting the oil filter assembly 200 through the second flow port 218 and third flow port 217. Alternatively, the first flow port 216, the second flow port 218, or third flow port 217 need not be used. The first flow port 216, the second flow port 218, and third flow port 217 can be plugged by using a first bolt 254, a second bolt 256, and third bolt 255 to prevent oil from leaving the oil filter assembly 200.

Figure 16:
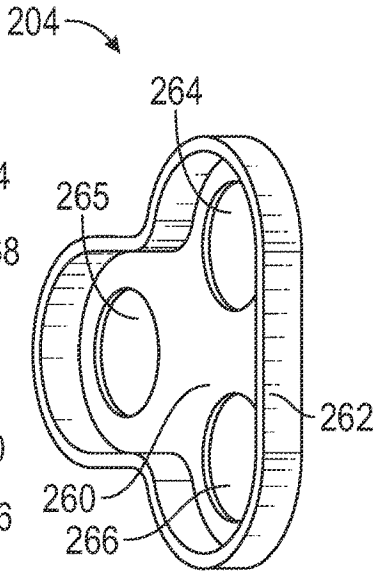
FIG. 16 is a second perspective view of the oil filter housing second portion.
Figure 15:
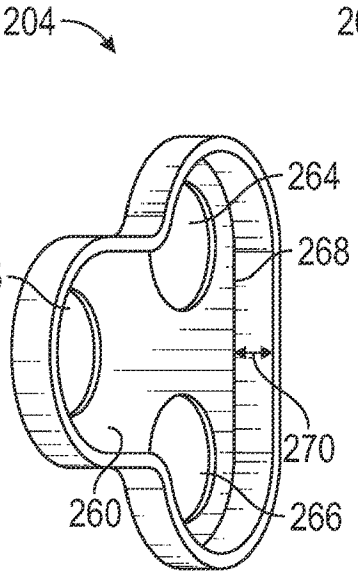
FIG. 15 is a first perspective view of the oil filter housing second portion.
Figure 14:
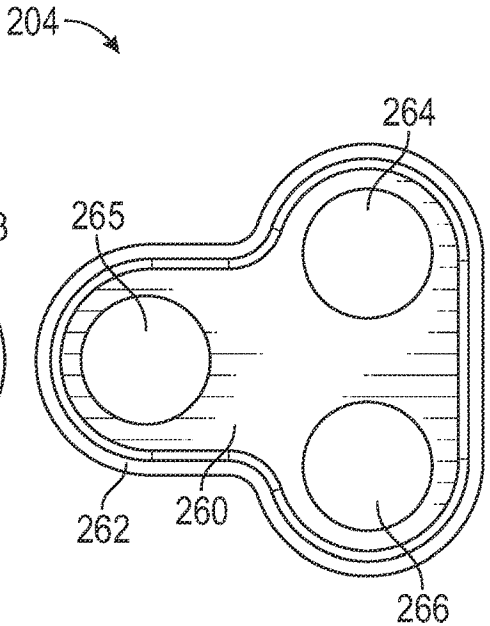
FIG. 14 is a bottom view of the oil filter housing second portion.
Figure 13:
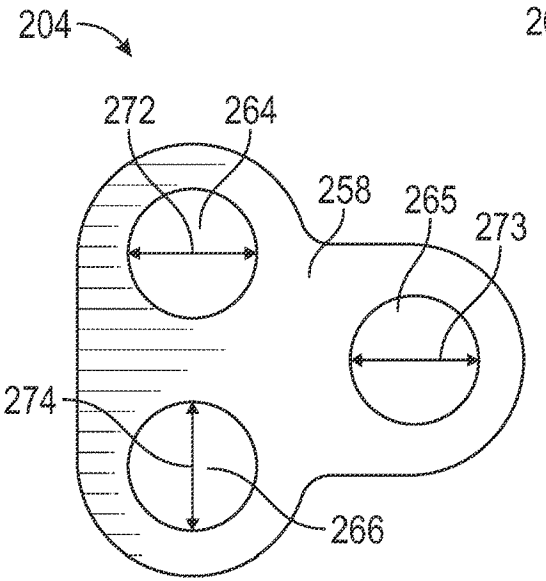
FIG. 13 is a top view of the oil filter housing second portion.

Each of FIGS. 13, 14, 15, and 16 illustrates the oil filter housing second portion 204. The oil filter housing second portion 204 can be any shape; however, in the illustrated embodiment the oil filter housing second portion 204 has a shape having three lobes. The oil filter housing second portion 204 has an oil filter housing second portion first surface, an oil filter housing second portion second surface 260 opposing the oil filter housing second portion first surface 258, a perimeter wall 262. The oil filter housing second portion 204 defining a first hole 264, a second hole 266, and a third hole 265 each of which extends through the oil housing second portion from the oil filter housing second portion first surface to the oil filter housing second portion second surface. In the illustrated embodiment, the perimeter wall 262 extends fully around the oil filter housing second portion 204 and orthogonally away from the oil filter housing second portion first surface 258. The perimeter wall 262 has a perimeter wall height 270 that is approximately 5 mm; however, the perimeter wall can have any perimeter wall height 270 including, but not limited to, 1 mm, 2 mm, 4 mm, 6 mm, or 10 mm. The first hole 264, a second hole 266, and the third hole 265 extend from the oil filter housing second portion first surface 258 to the oil filter housing second portion second surface 260. In the illustrated embodiment, the first hole 264 has a first diameter 272, the second hole 266 has a second diameter 274, and the third hole 265 has a third diameter 273. The first diameter 272, the second diameter 274, and the third diameter 273 are all different sizes to allow an individual to know what line, not illustrated, is to go in which hole. The first diameter 272 is approximately 14 mm, the second diameter 274 is approximately 16 mm, and the third diameter 273 is approximately 18 mm. Although the illustrated embodiment shows that the first hole 264, the second hole 266, and the third hole 265 are the same size, in alternative embodiments the first hole 264, the second hole 266, and the third hole 265 can be different sizes. Alternatively, two of the holes could be the same and one be different. The oil filter housing second portion 204 is configured to be disposed on the oil filter housing first portion 202 such that the first flow port 216 extends through the first hole 264, the second flow port 218 extends through the second hole 266, the third flow port 217 extends through the third hole 265, and the perimeter wall 268 extends toward the oil filter housing first portion 202. A first washer 282, a second washer 284, and a third washer 283 can be disposed between the oil filter housing second portion 204 and the oil filter housing first portion 202 to help prevent oil from leaking from the first flow port 216, the second flow port 218, and the third flow port 217. The oil filter housing second portion 204 provides several benefits to the oil filter assembly 200. To start with, the oil filter housing second portion 204 provides support to lines that can be installed from the motor to the oil filter assembly 200. Further, the oil filter housing second portion 204 provides a means to keep lines together while attaching them to the first flow port 216, the second flow port 218, and the third flow port 217. The lines are not illustrated; however, these lines can be replaced with the illustrated first bolt 254, second bolt 256, and third bolt 255 when the first flow port 216, the second flow port 218, and third flow port 217 are not in use. The oil filter housing second portion 204 can be made from any desired material including, but not limited to, metals, polymers, and ceramics. The material of the oil filter housing second portion 204 can be the same material, or a different material, than that of oil filter housing first portion 202.

The oil filter assembly 200 further comprises the oil cooler 206, best seen in FIGS. 9, 10, 11, and 12, that is removably attached to the first surface of the oil filter housing first portion 202. The oil cooler 206 has an oil cooler length 286, an oil cooler width 288, an oil cooler first surface 290 and an oil cooler second surface 292. The oil cooler 206 is removably attached to the oil filter housing first portion first surface 226 by a plurality of bolts; however, any means of attachment can be used to attach the oil cooler 206 to the oil filter housing first portion 202. The oil cooler height 294 extending from the oil cooler first surface 290 to the oil cooler second surface 292. The oil cooler 206 has at least one oil cooler vertical channel 296 extending from the oil cooler second surface 290 in a direction of the oil cooler first surface 292. Although not illustrated, the illustrated embodiment has four oil cooler vertical channels 296. These oil cooler vertical channels 296 allow oil to flow through the oil cooler 206 to help lower the temperature of the oil. The oil cooler vertical channels 296 are configured to mate with the oil filter housing first portion vertical channels 240 to allow oil to flow to and from the oil filter housing first portion.

Figure 17:
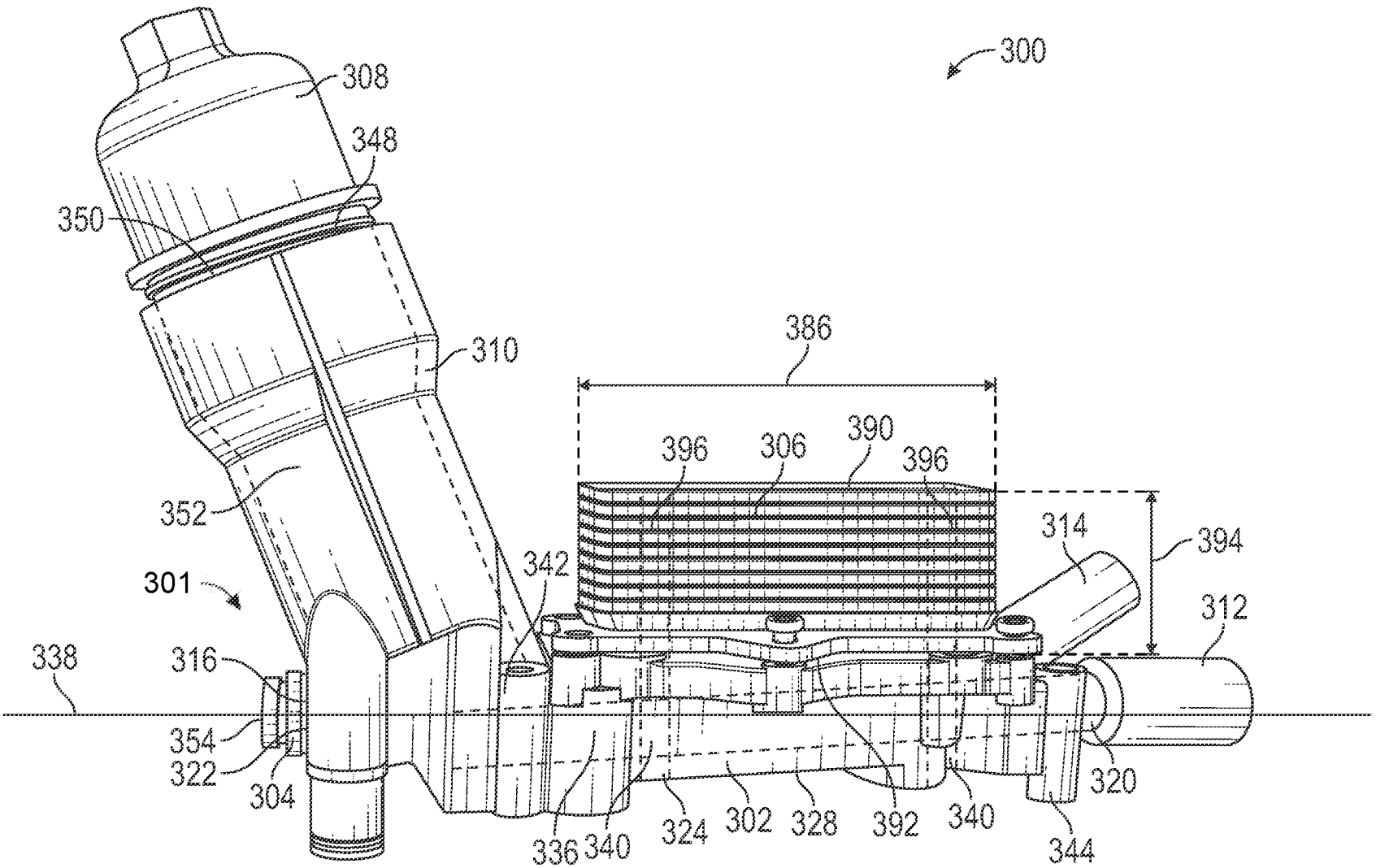
FIG. 17 is a first side view of a third example oil filter assembly.
Figure 18:
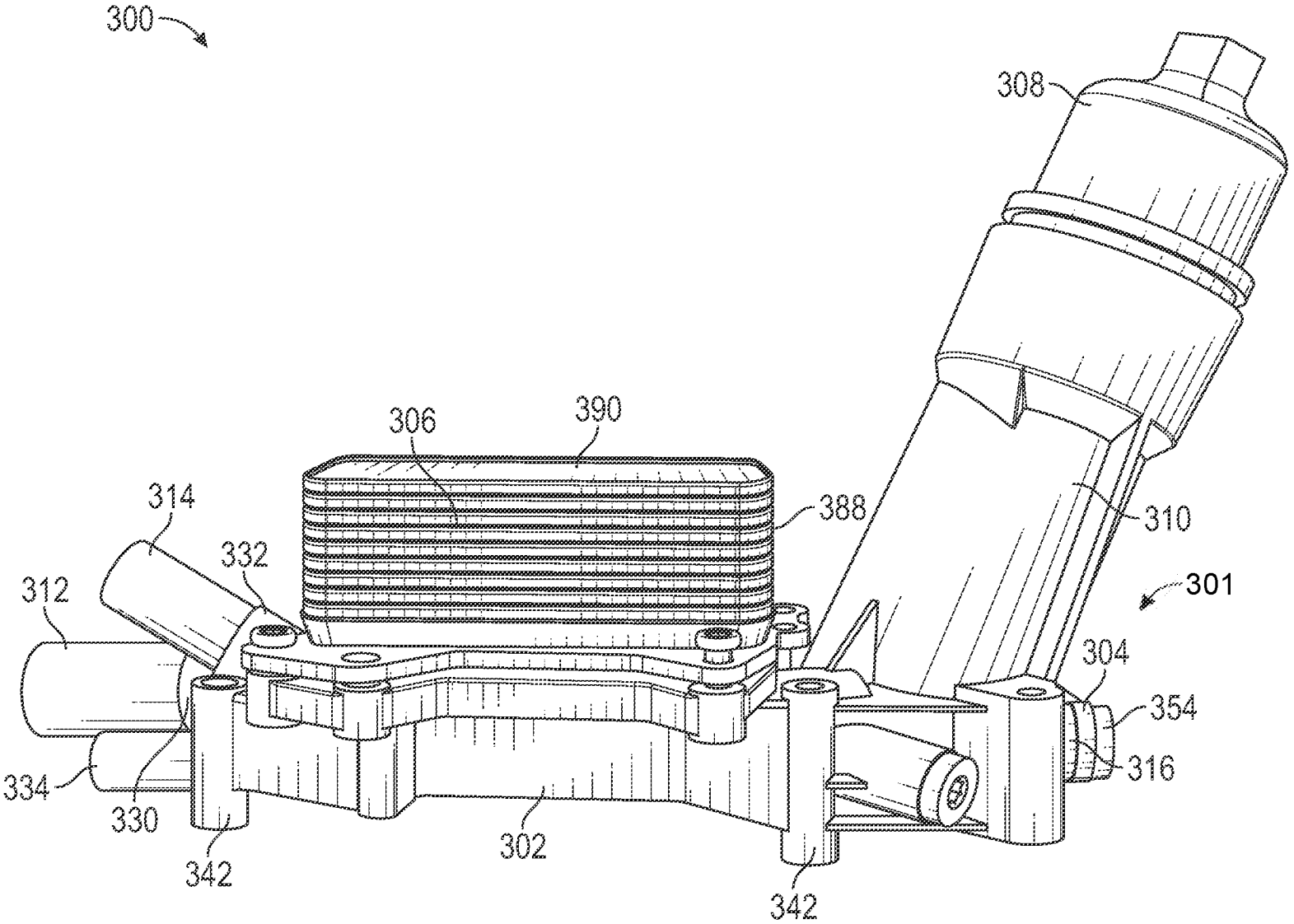
FIG. 18 is a second side view of the third example oil filter assembly.
Figure 19:
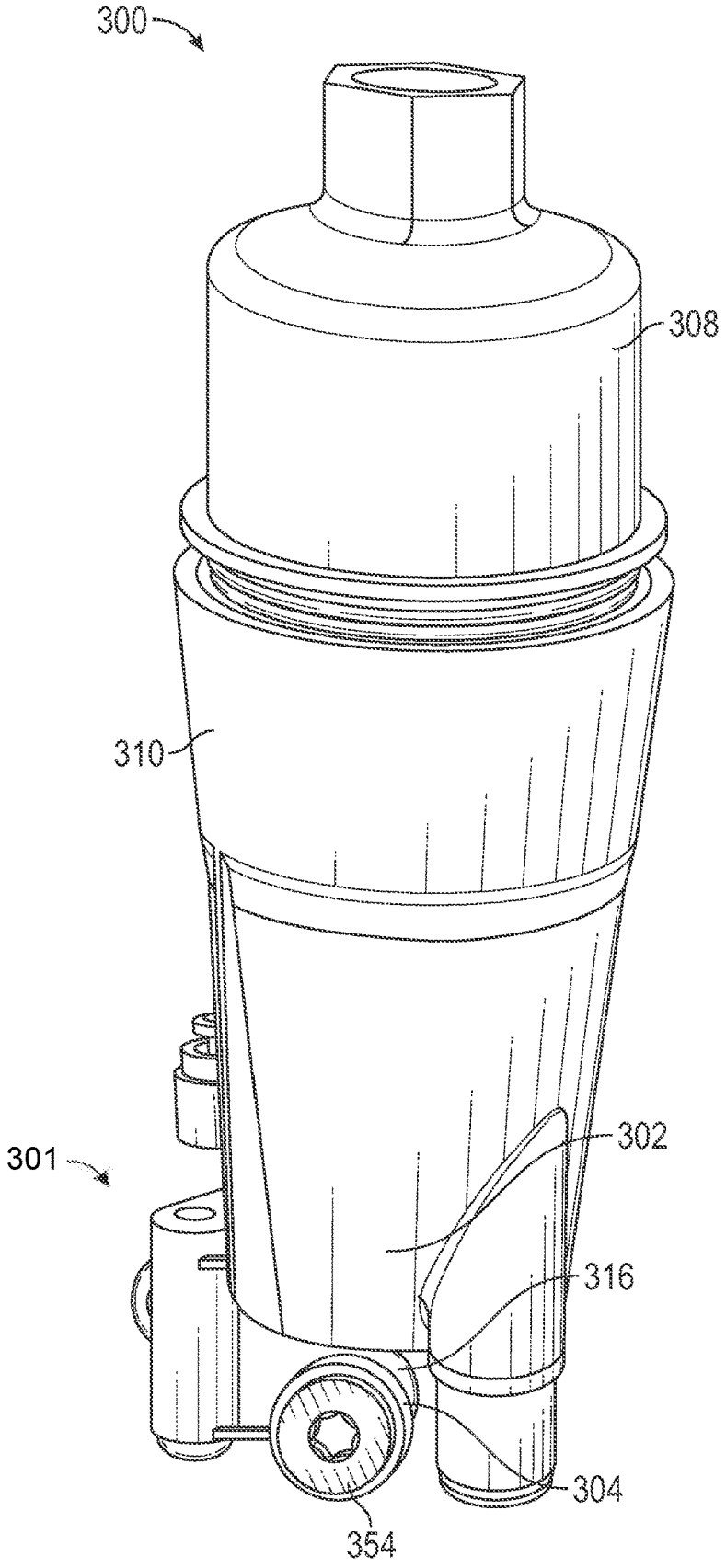
FIG. 19 is a third side view of the third example oil filter assembly.
Figure 20:
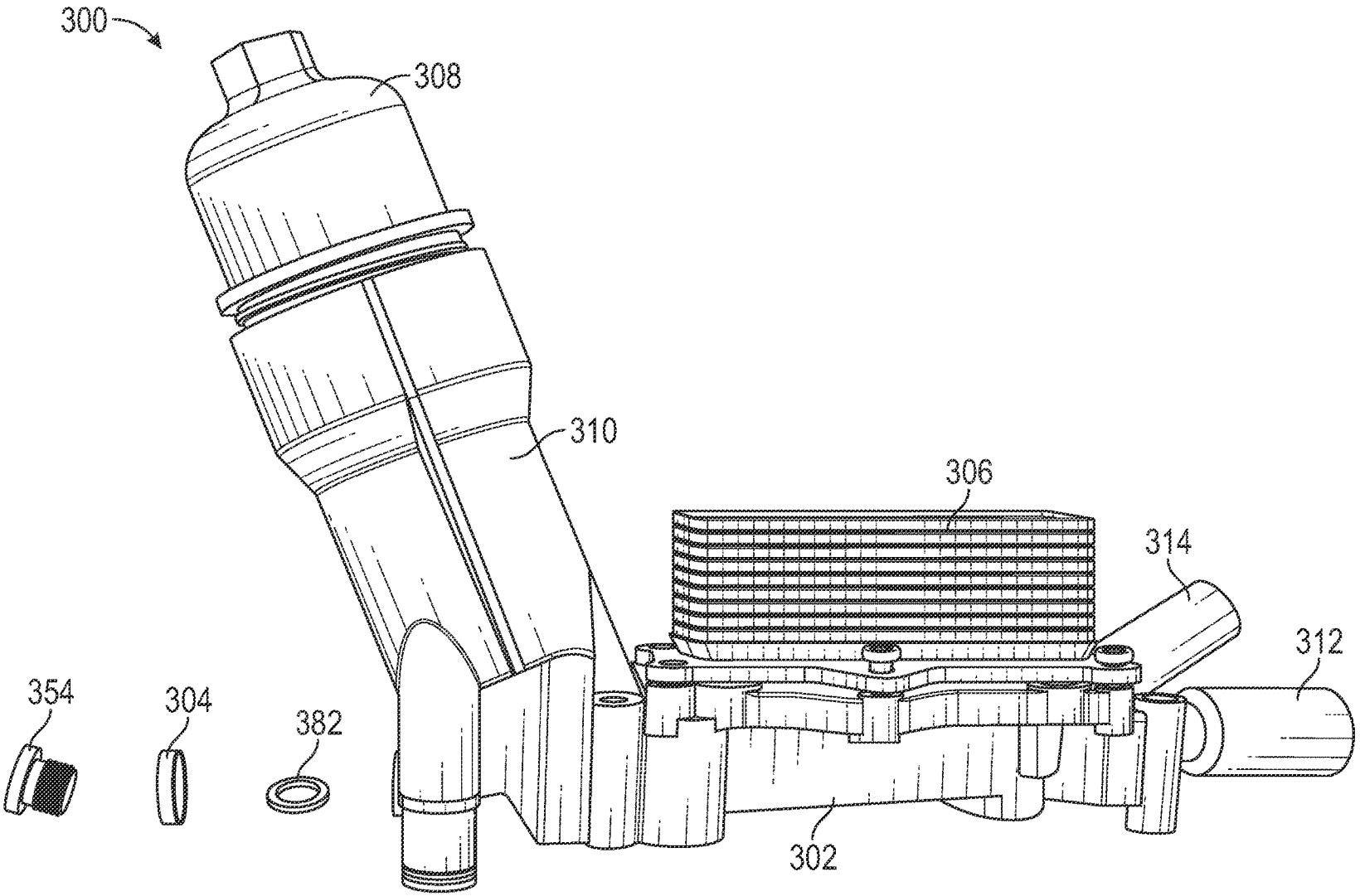
FIG. 20 is a partially exploded view of the first side view of the third example oil filter assembly having an oil filter housing second portion removed from an oil filter housing first portion.

Each of FIGS. 17, 18, 19, and 20 illustrates a third example oil filter assembly 300. The oil filter assembly 300 includes an oil filter housing 301, an oil filter (not illustrated) disposed in an oil filter tube 310 defined by the oil filter housing 101, and an oil cooler 306. The oil filter housing 301 has an oil filter housing first portion 302 and an oil filter housing second portion 304. The oil filter assembly 300 further has a cap 308, a first electrical connector 312, a second electrical connector 314, and a singular flow port 316.

As illustrated, the oil filter housing first portion 302 has an oil filter housing first portion first end 320, an oil filter housing first portion second end 322, and an oil filter housing first portion intermediate portion 324 extending between the oil filter housing first portion first end 320 and the oil filter housing first portion second end 322. The oil filter housing first portion 302 further has an oil filter housing first portion first surface 326 and an oil filter housing first portion second surface 328. The oil filter housing first portion first end 320 comprises a first port 330 and a second port 332. The oil filter housing first portion first end 320 can have as many ports as desired including, but not limited to, one, three, five, or six. The first port 330 has the first electrical connector 312 at least partially disposed in the first port 330, and the second port 332 has the second electrical connector 314 at least partially disposed in the second port 332. The oil filter housing first portion first end 320 can also have a hose attachment point 334 in which extends away from the oil filter housing first portion first end 320. The hose attachment point 334 can be configured to receive a hose, not illustrated, to transfer oil from the oil filter assembly 300 to a motor or from the motor to the oil filter assembly 300. The oil filter housing first portion 302 can further have a channel 336 extending along an axis 338 within the oil filter housing first portion intermediate portion 324 that oil can flow through. The oil filter housing first portion 302 can have any number of channels 336 extending along the axis 338 within the oil filter housing first portion intermediate portion 324. The oil filter housing first portion 302 can be made from any desired material including, but not limited to metals, polymers, and ceramics.

The oil filter housing first portion intermediate portion 324 can have an oil filter housing first portion vertical channel 340 extending from the oil filter housing first portion first surface 326 and the oil filter housing first portion second surface 328. In the illustrated embodiment, the oil filter assembly 300 has four oil filter housing first portion vertical channels 340. However, the oil filter assembly 300 can have any number of oil filter housing first portion vertical channels 340 including, but not limited to, one, two, three, seven or ten. The oil filter housing first portion 302 can further have a plurality of retaining apertures 342 around an exterior perimeter 344. Each of the retaining apertures 342 is configured to receive a bolt. The retaining apertures 342 are configured to secure the oil filter assembly 300 in place. For example, the retaining apertures 342 can be used to secure the oil filter assembly 300 to a motor.

The oil filter housing first portion 302 further comprises the oil filter tube 310. The oil filter tube 310 can extend in a direction away from the oil filter housing first portion second surface 328. The oil filter tube 310 has an oil filter tube distal end 346 and an oil filter tube proximal end 348. The oil filter tube proximal end 348 can have an oil filter tube opening 350 having internal threads that are adapted to receive external threads of the cap 308. Although in the illustrated embodiment the oil filter tube opening 350 has internal threads and the cap 308 has external threads, in alternative embodiments the threads can be reversed. The cap 308 can be made from any desired material including, but not limited to, polymers and metals. The cap 308 can further have a filter attached thereto, and the filter is configured to be disposed within the oil filter tube 310 through the oil filter tube proximal end 348. The oil filter assembly 300 can further have an oil filter tube cavity 352 that extends from the oil filter tube 310 in a direction towards the second surface of the oil filter housing first portion 302. In the illustrated embodiment the oil filter tube cavity 352 has an O-ring that is configured to prevent oil from leaking from the oil filter assembly 300. Also, the oil filter tube 310 is adapted to receive an oil filter. The oil filter can be attached to the cap 308; however, it doesn't have to be. The cap 308 can also be made from a different material than the oil filter housing first portion 302 and the oil filter housing second portion 304.

The oil filter housing first portion 302 further includes the flow port 316. Although the illustrated embodiment only has one flow port 316, any desired number flow ports may be present including, but not limited to, two, three, four, six, or seven. The flow port 316 can serve as any desired functionality. For example, the flow port can transfer hot oil from the engine to be filtered and cooled, or the flow port can transfer cooled oil from the oil filter assembly 300 to a motor. Alternatively, the flow port 316 need not be used. The flow port 316 can be plugged by using a bolt 354 to prevent oil from leaving the oil filter assembly 300 through the flow port 316.

Figure 21:
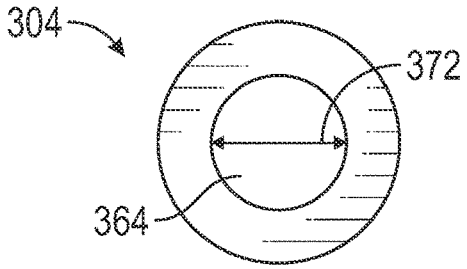
FIG. 21 is a top view of the oil filter housing second portion.
Figure 22:
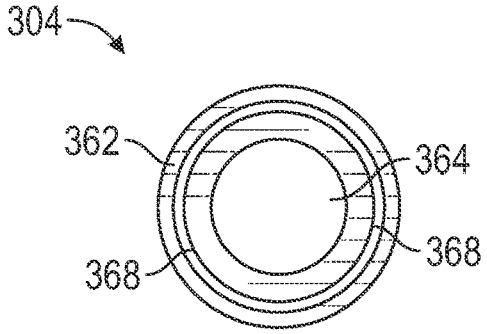
FIG. 22 is a bottom view of the oil filter housing second portion.
Figure 23:
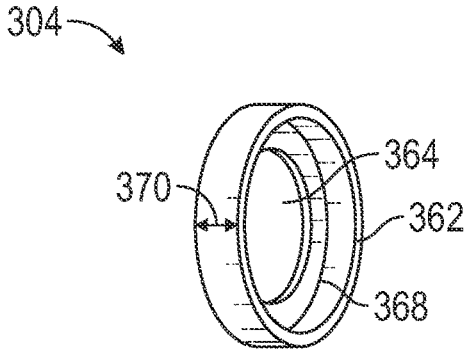
FIG. 23 is a first perspective view of the oil filter housing second portion.
Figure 24:
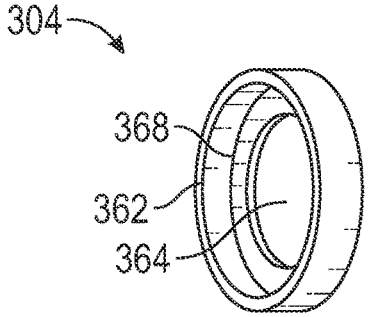
FIG. 24 is a second perspective view of the oil filter housing second portion.

Each of FIGS. 21, 22, 23, and 24 illustrates the oil filter housing second portion 304. The oil filter housing second portion 304 is circular shaped; however, any desired shape can be used. The oil filter housing second portion 304 has an oil filter housing second portion first surface 358, an oil filter housing second portion second surface 360 opposing the oil filter housing second portion first surface 358, a perimeter wall 362. The oil filter housing second portion 304 defining a hole 364 which extends through the oil filter housing second portion 304 from the oil filter housing second portion first surface 358 to the oil filter housing second portion second surface 360. In the illustrated embodiment, the perimeter wall 362 extends fully around the oil filter housing second portion 304 and orthogonally away from the oil filter housing second portion first surface 358. The perimeter wall 362 has a perimeter wall height 370 that is approximately 5 mm; however, the perimeter wall 370 can have any perimeter wall height 370 including, but not limited to, 1 mm, 2 mm, 4 mm, 6 mm, or 10 mm. The oil filter housing second portion 304 further has a hole 364 that extends from the oil filter housing second portion first surface 358 to the oil filter housing second portion second surface 360. In the illustrated embodiment, the hole 364 has a diameter 372. The diameter 372 in the illustrated embodiment is approximately 14 mm. However, any desired size can be used including, but not limited to, 9 mm, 10 mm, 12 mm, 15 mm, and 20 mm. The oil filter housing second portion 304 has a diameter 372 that is approximately 22 mm; however, the oil filter housing second portion 304 can have any desired diameter 372. The oil filter housing second portion 304 is configured to be disposed on the oil filter housing first portion 302 such that the flow port 316 extends through the hole 364 and the perimeter wall 368 extends toward the oil filter housing first portion 302. A washer 382 can be disposed between the oil filter housing second portion 304 and the oil filter housing first portion 302 to help prevent oil from leaking from the flow port 316. The oil filter housing second portion 304 provides several benefits to the oil filter assembly 300. To start with, the oil filter housing second portion 304 provides support to a line that can be installed from the motor to the oil filter assembly 300. The line is not illustrated; however, this line can be replaced with the illustrated bolt 354 when the flow port 316 is not in use. The oil filter housing second portion 304 can be made from any desired material including, but not limited to, metals, polymers, and ceramics. The material of the oil filter housing second portion 304 can be the same material, or a different material, than that of oil filter housing first portion 302.

The oil filter assembly 300 further comprises the oil cooler 306, best seen in FIGS. 17, 18, 19, and 20, that is removably attached to the oil filter housing first portion first surface 326. The oil cooler 306 has an oil cooler length 386, an oil cooler width 388, an oil cooler first surface 390 and an oil cooler second surface 392. The oil filter housing second portion 304 is removably attached to the first surface of the oil filter housing first portion by a bolt; however, any means of attachment can be used to attach the oil cooler 306 to the oil filter housing second portion 304. The oil cooler height 394 extending from the oil cooler first surface 390 to the oil cooler second surface 392. The oil cooler 306 has at least one oil cooler vertical channel 396 extending from the oil cooler second surface 392 in a direction of the oil cooler first surface 390. Although not illustrated, the illustrated embodiment has four oil cooler vertical channels 396. These channels allow oil to flow through the oil cooler 306 to help lower the temperature of the oil. The oil cooler vertical channels 396 are configured to mate with the oil filter housing first portion vertical channels 340 to allow oil to flow to and from the oil filter housing first portion 302.

Those with ordinary skill in the art will appreciate that various modifications and alternatives for the described and illustrated examples can be developed in light of the overall teachings of the disclosure, and that the various elements and features of one example described and illustrated herein can be combined with various elements and features of another example without departing from the scope of the invention. Accordingly, the particular examples disclosed herein have been selected by the inventors simply to describe and illustrate examples of the invention and are not intended to limit the scope of the invention or its protection, which is to be given the full breadth of the appended claims and any and all equivalents thereof.

We claim:

1. An oil filter assembly, comprising:

An oil filter housing first portion having an oil filter housing first portion first end, an opposing oil filter housing first portion second end, an oil filter housing first portion first surface and an opposing oil filter housing first portion second surface, the oil filter housing first portion first end defining an oil filter tube, the oil filter housing first portion second end defining first and second flow ports, the oil filter housing first portion first surface adapted for a secured connection with an internal combustion engine;

an oil filter housing second portion having an oil filter housing second portion first surface, an oil filter housing second portion second surface opposing the oil filter housing second portion first surface, a perimeter wall extending fully around the oil filter housing second portion and orthogonally away from the oil filter housing second portion first surface, the oil filter housing second portion defining first and second holes extending through the oil filter housing second portion from the oil filter housing second portion first surface to the oil filter housing second portion second surface, the oil filter housing second portion disposed on the oil filter housing first portion such that the first flow port extends through the first hole, the second flow port extends through the second hole, and the perimeter wall extends toward the oil filter housing first portion;

an oil filter adapted to be disposed within the oil filter tube; and an oil cooler adapted to be secured to the oil filter housing first portion first surface.

2. The oil filter assembly of claim 1, further comprising a third flow port on the oil filter housing first portion second end.

3. The oil filter assembly of claim 2, further comprising a third hole extending from the oil filter housing second portion first surface through the oil filter housing second portion second surface.

4. The oil filter assembly of claim 3, wherein the oil filter housing second portion is disposed over the first flow port, the second flow port, and the third flow port.

5. The oil filter assembly of claim 3, wherein the first hole has a first diameter, the second hole has a second diameter, and the third hole has a third diameter; and wherein the first diameter, the second diameter, and the third diameter are different.

6. The oil filter assembly of claim 3, wherein the first hole has a first diameter, the second hole has a second diameter, and the third hole has a third diameter; and wherein the first diameter, the second diameter, and the third diameter are approximately the same.

7. The oil filter assembly of claim 3, wherein the first hole has a first diameter, the second hole has a second diameter, and the third hole has a third diameter; and wherein at least one of the first diameter, second diameter, or third diameters are different.

8. The oil filter assembly of claim 1, further comprising a cap that is configured to attach to the oil filter tube.

9. The oil filter assembly of claim 8, wherein the oil filter is attached to the cap.

10. The oil filter assembly of claim 8, wherein the cap is made from a first material and the oil filter housing first portion is made from a second material, the first material being different from the second material.

11. The oil filter assembly of claim 1, wherein the oil filter tube extends in a direction away from the oil filter housing first portion second surface.

12. The oil filter assembly of claim 1, wherein the oil filter tube has an oil filter tube proximal end having an oil filter tube opening that is adapted to receive a cap.

13. The oil filter assembly of claim 1, wherein the first hole has a first diameter and the second hole has a second diameter; and wherein the first diameter and the second diameter are different.

14. The oil filter assembly of claim 1, wherein the first hole has a first diameter and the second hole has a second diameter; and wherein the first diameter and the second diameter are approximately the same.

15. The oil filter assembly of claim 1, wherein the perimeter wall has a perimeter wall height; and wherein the perimeter wall height is approximately 5 mm.

16. The oil filter assembly of claim 1, wherein the oil cooler is removably attached to the oil filter housing first portion.

17. The oil filter assembly of claim 1, wherein the oil cooler has an oil cooler first surface and an oil cooler second surface; and wherein the oil cooler has at least one channel extending from the oil cooler second surface in a direction of the oil cooler first surface.

18. The oil filter assembly of claim 1, wherein the oil cooler has an oil cooler first surface and an oil cooler second surface; and wherein the oil cooler has a plurality of oil cooler vertical channels extending from the oil cooler second surface in a direction of the oil cooler first surface.

19. An oil filter assembly, comprising:

an oil filter housing first portion having an oil filter housing first portion first end, an opposing oil filter housing first portion second end, an oil filter housing first portion first surface, and an opposing oil filter housing first portion second surface, the oil filter housing first portion first end defining an oil filter tube, the oil filter housing first portion second end defining a flow port, the oil filter housing first portion first surface adapted for a secured connection with an internal combustion engine;

an oil filter housing second portion having an oil filter housing second portion first surface, an opposing oil filter housing second portion second surface opposing the oil filter housing second portion first surface, a perimeter wall extending fully around the oil filter housing second portion and orthogonally away from the oil filter housing second portion first surface, the oil filter housing second portion defining a hole extending through the oil filter housing second portion from the oil filter housing second portion first surface to the oil filter housing second portion second surface, the oil filter housing second portion disposed on the oil filter housing first portion such that the flow port extends through the hole, and the perimeter wall extends toward the oil filter housing first portion;

an oil cooler having an oil cooler first surface and an oil cooler second surface removably attached to the oil filter housing first portion first surface; and an oil filter adapted to be disposed within the oil filter tube.

20. An oil filter assembly, comprising:

an oil filter housing first portion having an oil filter housing first portion first end and an opposing oil filter housing first portion second end, an oil filter housing first portion first surface and an opposing oil filter housing first portion second surface, the oil filter housing first portion first end defining an oil filter tube, the oil filter housing first portion second end defining a flow port, the first surface adapted for secured connection with an internal combustion engine, the oil filter housing first portion having an oil filter housing first portion vertical channel extending from the oil filter housing first portion first surface to the oil filter housing first portion second surface;

an oil filter housing second portion having an oil filter housing second portion first surface, an oil filter housing second portion second surface opposing the oil filter housing second portion first surface, a perimeter wall extending fully around the oil filter housing second portion and orthogonally away from the oil filter housing second portion first surface, the oil filter housing second portion defining a hole extending through the oil filter housing second portion from the oil filter housing second portion first surface to the oil filter housing second portion second surface, the oil filter housing second portion disposed on the oil filter housing first portion such that the flow port extends through the hole, and the perimeter wall extends toward the oil filter housing first portion;

an oil cooler having an oil cooler first surface and an oil cooler second surface removably attached to the oil filter housing first portion first surface, the oil cooler having an oil cooler vertical channel extending from the oil cooler second surface in a direction toward the oil cooler first surface; and an oil filter adapted to be disposed within the oil filter tube.

* * * * *